US005797070A

United States Patent [19]

Waki et al.

[11] Patent Number: 5,797,070

[45] Date of Patent: Aug. 18, 1998

[54] IMAGE-FORMING APPARATUS FEATURING A PLURALITY OF IMAGE FORMING MEANS

[75] Inventors: Kenichiro Waki, Kawasaki; Masahiro Itoh, Odawara; Hiroyuki Suzuki, Yokohama; Ryo Inoue, Tokyo, all of Japan

[73] Assignee: Canon Kabushiki Kaisha, Japan

[21] Appl. No.: 845,285

[22] Filed: Apr. 21, 1997

Related U.S. Application Data

[63] Continuation of Ser. No. 558,185, Nov. 15, 1995, abandoned.

[30] Foreign Application Priority Data

Nov. 17, 1994 [JP] Japan ..... 6-307095
Sep. 18, 1995 [JP] Japan ..... 7-238406

[51] Int. Cl.[6] ..... G03G 15/01; G03G 15/30

[52] U.S. Cl. ..... 399/149; 399/231; 430/109; 430/111

[58] Field of Search ..... 399/149, 231, 399/150; 430/66, 67, 109, 111

[56] References Cited

U.S. PATENT DOCUMENTS

| | | | |
|---|---|---|---|
| 4,162,843 | 7/1979 | Inoue et al. | 355/327 |
| 5,249,022 | 9/1993 | Watanabe et al. | 355/271 |
| 5,323,185 | 6/1994 | Nagato et al. | 346/159 |
| 5,324,609 | 6/1994 | Yagi et al. | 430/66 |
| 5,363,178 | 11/1994 | Matsumoto | 355/273 |

FOREIGN PATENT DOCUMENTS

| | | |
|---|---|---|
| 0575159 | 12/1993 | European Pat. Off. . |
| 53-74037 | 7/1978 | Japan . |
| 53-790037 | 7/1978 | Japan . |
| 55-38525 | 3/1980 | Japan . |
| 50-53482 | 3/1983 | Japan . |
| 01-273076 | 10/1989 | Japan . |
| 1-273076 | 10/1989 | Japan . |
| 02-208669 | 8/1990 | Japan . |
| 2-208667 | 8/1990 | Japan . |
| 60-75484 | 3/1994 | Japan . |

OTHER PUBLICATIONS

European Search Report dated Feb. 23, 1996.

*Primary Examiner*—William J. Royer
*Attorney, Agent, or Firm*—Fitzpatrick, Cella, Harper & Scinto

[57] ABSTRACT

An image forming apparatus includes at least a first image-forming unit provided with a first latent image-holding member, a first latent image-forming device, a first developing device for developing a first latent image with a first toner to form a first toner image, and a first image-transfer device for transferring the first toner image to an image-receiving member, and a second image-forming unit provided with a second latent image-holding member, a second latent image-forming device, a second developing device for developing a second latent image with a second toner to form a second toner image, and a second image-transfer device for transferring the second toner image to the image-receiving member holding the first toner image. The second developing device also serves as a cleaning device for recovering the toner remaining on the second latent image-holding member after the transfer to perform cleaning. The second latent image-holding member has a surface having a contact angle for water of not less than 85°.

88 Claims, 8 Drawing Sheets

IMAGE-FORMING APPARATUS FEATURING A PLURALITY OF IMAGE FORMING MEANS

This application is a continuation of application Ser. No. 08/558,185 filed Nov. 15, 1995, now abandoned.

BACKGROUND OF THE INVENTION

1. Field of the Invention

The present invention relates to an image-forming apparatus utilizing an image-forming process such as electrostatic recording processes and electrophotographic processes, particularly to a multi-color image forming apparatus for forming a multi-color image by multiple transfer of developed images from plural image information-holding members. The image-forming apparatus of the present invention is useful for electrophotographic copying machines, printers, facsimiles, and so forth.

2. Related Background Art

In recent years, image-forming apparatuses such as electrophotographic apparatuses have been improved to be smaller in size, to perform more diverse functions, and to form more colorful images. The image-forming apparatuses are further required to be more reliable, to be applicable to more types of systems, to be free from maintenance operation, to be safe to humans, not to pollute environment, and so forth. Many improvements have been proposed to meet the above requirements.

Japanese Patent Application Laid-open No. 53-74037 (corresponding to U.S. Pat. No. 4,162,843) discloses an image-forming apparatus which is provided with plural photosensitive members and successively effects multiple transfer of toner images while transporting an image-receiving material with a belt-shaped transporting means in order to output color images at a high speed.

In recent years, copying machines and printers of cleaner-less type, a so-called developing-and-cleaning type (in which cleaning is carried out simultaneously with developing), have come to be used practically, in which a toner remaining after transfer is recovered and reused for the purposes of miniaturization of the entire apparatus, no discharge of waste toner not to cause environmental pollution, elongation of the life of the photosensitive member, and curtailment of toner consumption per page in printing. In such a type of system, it is desirable that the spherical particles of a toner produced by polymerization are used.

The developing-and-cleaning type is expected to be effective also in the image-forming apparatus disclosed in Japanese Patent Application Laid-Open No. 53-74037 which is provided with plural photosensitive members to transfer multiple toner images successively, in consideration of miniaturization of the entire apparatus, no waste toner discharge not to cause environmental pollution, elongation of the life of the photosensitive member, and curtailment of toner consumption for printing.

However, when the developing-and-cleaning system is introduced to the above multiple transfer type image forming apparatus having plural photosensitive members and successively effecting multiple transfer, the following disadvantages are considered to arise.

As an example, a full-color image-forming apparatus has four image forming units for four toners of cyan, magenta, yellow, and black, each unit having a photosensitive member as the latent image holder, a primary electrifier as the electrifying means, a light image projector as the latent image-forming means, a development device as the image developing means, and an image transfer means for transferring the toner image of the respective colors successively onto a toner image-receiving material delivered by a transfer belt. When the above full-color image-forming apparatus is used in a two-color mode, magenta and cyan for example, a toner image-receiving material supported by a transfer belt passes successively through the magenta unit, the cyan unit, the yellow unit, and the black unit, although only the desired magenta image- and cyan image-forming units are required to work. However, the image-receiving material is delivered to pass successively through the units of magenta, cyan, yellow, and black. If the unnecessary unit, the yellow unit and the black unit in this case, is stopped entirely, the magenta-and-cyan color image formed on the image-receiving material is scraped by the respective photosensitive drums of the yellow unit and the black unit to have the image impaired remarkably, disadvantageously. In such a case, jamming of the image-receiving material is liable to occur at the gap between the drum and the belt. Such disadvantage can be avoided by allowing the unnecessary unit to run also. However, the unnecessary running may shorten the life of the parts, raise the running cost, and waste electric power. In the above step, the magenta toner and the cyan toner transferred onto the image-receiving material are attracted electrostatically by the image-receiving material. From the image-receiving material passing through the gaps between the photosensitive drums of yellow or black and the belt, the magenta-and-cyan toner image may partly be re-transferred to the photosensitive drum of yellow or black, which impairs the image seriously to cause irregularity or low density of the image, and disturbance of color balance, disadvantageously.

To offset such disadvantages, a method may be considered where the transfer belt is selectively pressed to or released from the photosensitive drums as disclosed in Japanese Patent Application Laid-Open No. 2-208669. In this method, however, a contact pressure-releasing mechanism is required for each of the unnecessary color image-forming units, and when the releasing mechanism operates, various mechanical vibrations are generated, which is liable to cause adverse effects on the image transfer. If the pressure-releasing mechanism is not operated during image formation to avoid the adverse effects, the printing speed becomes low.

Furthermore, even in full color formation employing all the image-forming units, the toner which has been transferred onto the image-receiving material sheet may be re-transferred to the succeeding drums in the following multiple transfer steps.

If the above-described re-transfer occurs, that is, re-transfer of a magenta or cyan toner onto a yellow or black photosensitive drum, the re-transferred toner is recovered into the development device of a different color because of the cleaner-less type photosensitive drum. This color toner mixing in the development device is a serious problem in full color image formation.

In order to prevent the re-transfer of the toner, a method is known in which the amounts of the electric charge of the toners are successively decreased from the first color in a wide range, since the re-transfer of the toner is due to an attracting force of electric field applied to the toner on the receiving sheet from a charged area of the photosensitive member. In this method, however, the formulation of the developing agent or the charging method has to be changed for each color toner, and therefore the developing agents or the development device constructions must be different from each other, disadvantageously.

Japanese Patent Application Laid-Open No. 1-273076 discloses precharging of the belt before its contact with a photosensitive member in the toner transfer since it is considered that the toner on a transfer sheet is electrified to the transfer polarity during transfer and is re-transferred by the homopolar repulsion to the charge of the belt. In this method, however, the charging has to be controlled continuously by monitoring the state of the charging of the belt, and in addition, the apparatus construction is complicated against simplification and cost reduction.

SUMMARY OF THE INVENTION

An object of the present invention is to provide an image-forming apparatus which does not involve the above disadvantages.

Another object of the present invention is to provide an image-forming apparatus which does not cause image deterioration by the toner re-transfer and color toner mixing in a development device in development- and-cleaning type of process.

A further object of the present invention is to provide an image-forming apparatus which is less liable to cause color change in reproduction of images in many sheets.

The image forming apparatus of the present invention comprises at least a first image-forming unit comprising a first latent image-holding member for holding a first electrostatic latent image, a first latent image-forming means for forming the first electrostatic latent image on the first latent image-holding member, a first developing means for developing the first latent image on the first latent image-holding member with a first toner to form a first toner image on the first latent image-holding member, and a first image-transfer means for transferring the first toner image from the first latent image-holding member onto an image-receiving member; and a second image-forming unit comprising a second latent image-holding member for holding a second electrostatic latent image, a second latent image-forming means for forming a second electrostatic latent image on the second latent image-holding member, a second developing means for developing the second latent image on the second latent image-holding member with a second toner to form a second toner image on the second latent image-holding member, and a second image-transfer means for transferring the second toner image from the second latent image-holding member onto the image-receiving member holding the first toner image having been formed thereon by the first image-forming unit, the second developing means also serving as a cleaning means for recovering the toner remaining on the second latent image-holding member after the image transfer to perform cleaning, wherein the second latent image-holding member has a surface having a contact angle for water of not less than 85°.

DESCRIPTION OF THE PREFERRED EMBODIMENTS

The mechanism of the toner re-transfer is described below, which is the important problem in achieving the object of the present invention.

Figure 2:
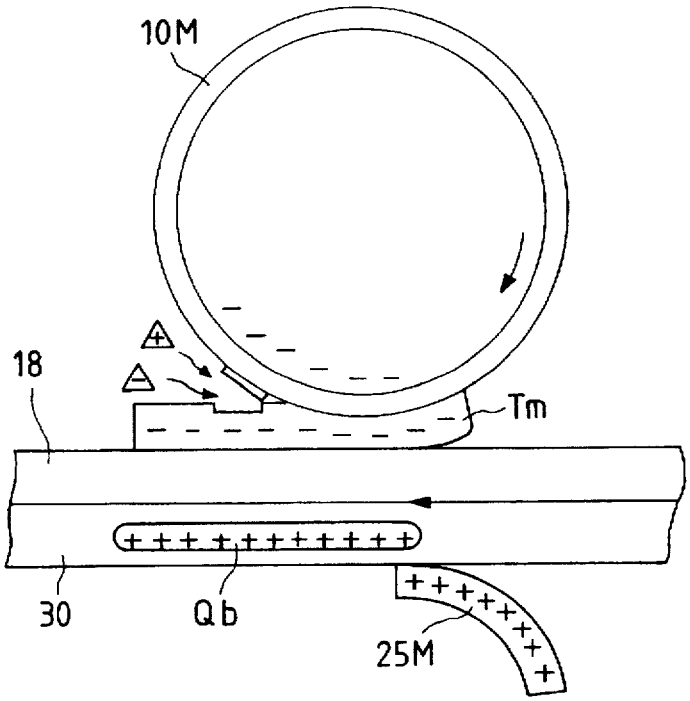
FIG. 2 shows a model for explaining re-transfer of a first color toner.

The development simultaneous with cleaning type development process, as described above, involves the disadvantage of contamination of a different color toner into the development device caused by re-transfer of the toner. This re-transfer phenomenon has been comprehensively studied by the inventors of the present invention. Consequently, it was found that the toner re-transfer is caused by a separation discharge between a photosensitive drum and a separating image-receiving paper sheet as the image-receiving member (including a transfer belt) as shown in FIG. 2. For example, in a known electrophotography process, as described above, a magenta toner image Tm formed on a photosensitive drum 10M as a latent image-holding member of a magenta unit is brought into close contact with a toner image-receiving material 18 which is carried on a transfer belt 30 and delivered synchronously with rotation of the photosensitive drum 10M. Simultaneously, a positive transfer charge Qb is applied to the transfer belt 30 by a contacted transfer blade 25M from the reverse face of the transfer belt as the transfer means to transfer the toner image Tm. The transfer charge Qb exerts electrostatic force to the negatively charged toner image Tm to attract it to the image-receiving material sheet 18. At the same time, the positive transfer charge Qb induces a negative charge on the photosensitive drum 10M. The two electrostatic forces attract the image-receiving material sheet 18 to the photosensitive drum 10M to bring the image-receiving material sheet 18 into close contact with the photosensitive drum 10M. Immediately thereafter, with the toner image Tm attracted by the image-receiving material sheet 18, the sheet 18 carried on the transfer belt 30 as well as the toner image Tm transferred to the receiving sheet 18 are separated from the photosensitive drum 10M due to the curvature of the drum 10M. This separation forms an air gap between the photosensitive drum 10M and the toner image Tm to decrease abruptly the electrostatic capacity to increase the potential difference there, generating thereby separation discharge.

In the separation discharge, the most portion of the positive and negative charges are generated in the narrow air gap between the photosensitive drum 10M and the toner image Tm. Owing to the electric field generated by the positive charge Qb given to the transfer belt 30 and the negative charge induced on the photosensitive drum 10M, the positive charge is induced on the photosensitive drum 10M and the negative charge is induced on the toner image Tm and the image-receiving material sheet 18. However, a fraction of the positive charge is induced also on the toner image Tm to reverse the polarity of some of the toner particles. The positive charge-induced toner particles are repelled by the positive charge Qb of the transfer belt 30 and are re-transferred to the photosensitive drum 10M. Most of the toner particles which have not been electrostatically reversed further receive the negative charge generated by the separation discharge to have increased charge, and are transferred onto the image-receiving material sheet 18.

Figure 3:
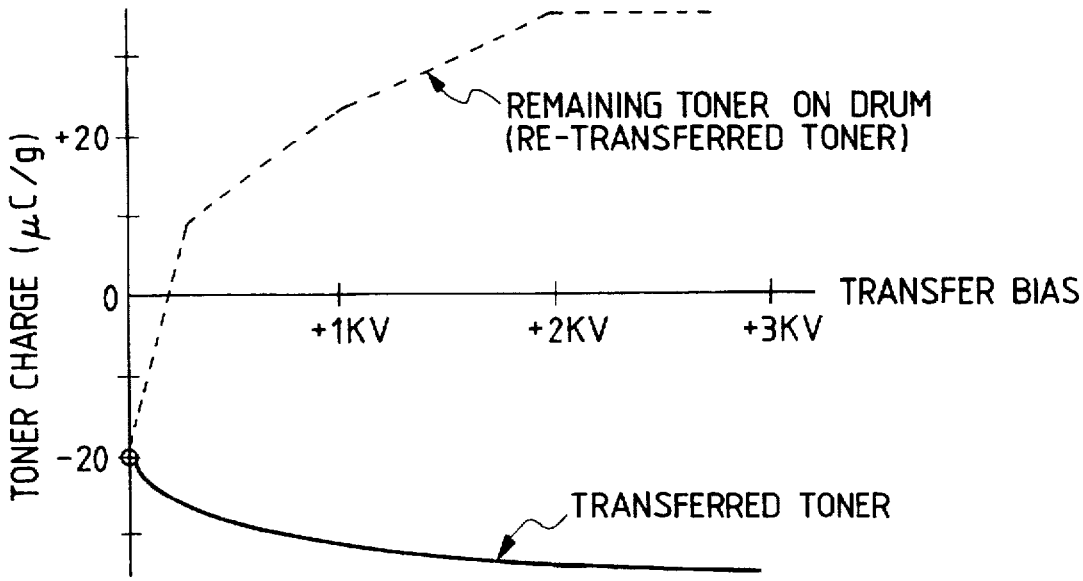
FIG. 3 is a graph showing electric charges of a transferred toner and a toner re-transferred onto a photosensitive drum after the toner transfer.

FIG. 3 shows practically measured dependence, on the transfer bias, of the amount of the electric charge of the magenta toner transferred onto image-receiving material sheet 18 and that of the toner re-transferred onto the photosensitive drum 10M. FIG. 3 shows that the absolute value of the electric charge of the transferred toner increases from the value before the transfer (−20 μC/g in this case), and the charge of the toner re-transferred onto the photosensitive drum is reversed, and that at the higher transfer bias the increase is more remarkable, and the separation discharge is more violent.

Figure 4:
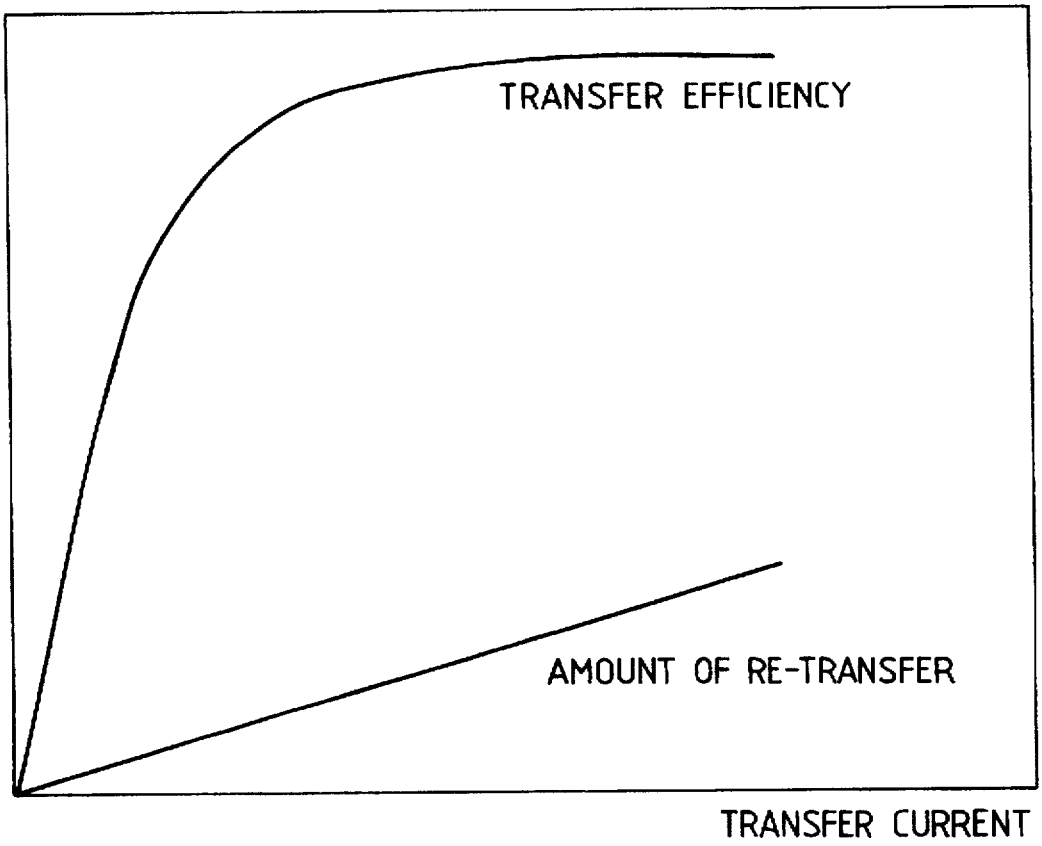
FIG. 4 shows dependence of transfer efficiency and re-transfer on electric current for the toner transfer.

FIG. 4 shows the relations between the transfer current and the transfer efficiency, and between the transfer current and the extent of the re-transfer. The transfer efficiency increases rapidly with increase of the transfer current, but becomes saturated at a certain current strength, whereas the amount of the toner re-transfer increases monotonously with the transfer current. Therefore less transfer current is preferred for less re-transfer. In practical operation, however, the transfer current strength is set at the saturation point of the transfer efficiency in consideration of adverse effects of higher transfer current such as scattering of the transferred toner image.

In practical operation as described above, the transfer current is set to obtain suitable transfer efficiency without considering the amount of the toner re-transfer, which tends to cause the toner re-transfer in practical apparatuses.

An image-forming unit of an image-forming apparatus of the present invention is described by reference to FIG. 1. The image-forming unit has a developing means serving also as a cleaning means for recovering the toner existing on the latent image-holding member to perform the cleaning.

An image-forming unit (magenta unit) UM has a cylindrical photosensitive drum member 10M as an electrostatic image-holding member which rotates in the direction indicated by the arrow mark a; a primary charger or electrifier 12M as an electrifying means which is set so as not to come into contact with the photosensitive drum 10M; a light image-projector 14M as a latent image-forming means which is located after the primary electrifier 12M in the drum rotation direction and projects a light image to form an electrostatic latent image on the photosensitive drum 10M; a development device 16M as the developing means which is located after the light exposure site in the drum rotation direction and in adjacent to the photosensitive drum 10M; a transfer blade 25M which is located so as to be opposed to the photosensitive drum 10M to pinch the image-receiving material sheet at the image transfer site during the transfer; and a pre-exposure lamp 13M which is located between the transfer blade 25M and the primary electrifier 12M.

This image-forming unit UM forms an electrostatic latent image by uniformly charging or electrifying primarily the photosensitive drum 10M by means of a primary charger or electrifier 12M and projecting light image by means of an image-projector 14M; develops the latent image with a magenta toner by means of the development device 16M; transfers the developed toner image onto an image-receiving member sheet by applying a transfer charge from the transfer blade 25M at the image transfer site; removes the electric charge of the photosensitive drum by means of the pre-exposure lamp 13M; and repeats the above cycle of the steps of primary electrification by the primary electrifier 12M, latent image formation by means of the image light exposure device 14M, and development by the development device 16M. The development by the development device 16M can be conducted, for example, by using a two-component developer composed of a toner and a carrier, bringing magnetic brushes formed from the two-component developer into contact with the photosensitive drum 10M, and allowing the toner to fly onto the photosensitive drum. At the development, the toner remaining on the photosensitive drum can be recovered to the development device after the image transfer by applying, for example, a development bias of frequency of 2 KHz, a peak voltage of 2 KV, and a DC component of −500V.

The image-forming apparatus of the present invention comprises plural image-forming units having a developing means working simultaneously as a cleaning means to recover the remaining toner on the image holding member, and the toner images formed by the plural image-forming units are transferred successively onto the toner image-receiving material sheet.

When a magenta unit is employed as the first of the color unit series, the toner contamination in the developer does not occur in a development-and-cleaning process even though a slight image deterioration occurs by re-transfer of the toner.

In the series of color units in which a cyan unit, a yellow unit, and a black unit having the same construction as the magenta color unit are successively arranged after the magenta unit to form toner images of cyan, yellow, and black on a transfer-receiving material carrying a magenta toner image, the separation discharge may be generated and the toner re-transfer may occur also in the second and following color units according to the same principle as in the first color unit. In this case, the first color toner is liable to be re-transferred in the second and following color units. Presumably, the electrification state of the toner on the transfer-receiving material will change at the transfer to become liable to be re-transferred. The toner re-transfer in the second or following color unit causes contamination of the toner with the toner of the previous color unit to disturb the color balance and impair the image quality.

The toner re-transfer is caused by the separation discharge generated between the photosensitive drum and the image-receiving sheet as described above. This separation discharge is closely related to the releasability of the toner from the photosensitive drum. In toner transfer from the photosensitive drum, the separation discharge tends to be greater when the toner is less readily removable. This is probably due to the fact that the transfer of the toner accompanies transfer of the electric charge to decrease the potential difference between the photosensitive drum and the transfer-receiving material, and less transferrable toner will result in less decrease of the potential difference to generate the discharge.

The separation discharge is suppressed in the present invention by adjusting the contact angle for water of the surface of the photosensitive member to be 85° or larger to improve the release property of the photosensitive member surface and facilitate the toner release from the surface at the time of transfer. Consequently the re-transfer of the toner is reduced. The contact angle for water of the surface of the photosensitive member in the present invention is not less than 85°, preferably not less than 90°, more preferably not less than 100° to obtain high toner releasability of the surface of the photosensitive member and to reduce the toner re-transfer. At the contact angle of less than 85°, the releasability of the surface of the photosensitive member is low and the re-transfer is not prevented substantially.

The contact angle for water of the surface of the latent image holding member, namely the photosensitive drum member, was measured with a Kyowa Contact-Angle Meter CA-DS (produced by Kyowa Kagaku K.K.).

To achieve a contact angle for water of the surface of the latent image holding member of 85° or larger in the present invention, the surface layer thereof is formed from a base resin such as a polycarbonate resin or a photo-curable acrylic resin in which a fluoro-resin is dispersed in a specified amount. The fluoro-resin content in the surface layer ranges preferably from 1 to 150 parts, more preferably from 5 to 100 parts by weight relative to 100 parts by weight of the base resin. At the content of the fluoro-resin of lower than 1 part by weight, the contact angle for water of the surface of the latent image holding member tends to be smaller than 85°, whereas at the content of higher than 150 parts by weight, the dispersion of the fluoro-resin can be insufficient and the durability of the latent image holding member tends to be lower.

The toner to be used in the image-forming apparatus of the present invention is preferably the one having a spherical or nearly spherical particle shape and having less surface irregularity rather than conventional pulverized toners produced from a toner material by melting, blending, pulverization, and classifying, in order to suppress toner re-transfer.

The mechanism of preventing the toner re-transfer by use of the spherical toner is explained by reference to FIG. 5, from the standpoint of adhesion of toner onto the photosensitive member.

The forces exerted to the toner are mainly an image force and a Van der Waals force. The image force depends largely on the electric charge and the distance. A conventional pulverized toner has an irregular surface, and protrusion portions of the toner particle surface are electrified selectively by frictional electrification.

In contrast, a spherical toner such as a polymerized toner produced by polymerization is electrified uniformly at the surface because of its spherical or nearly spherical shape. To a pulverized toner particle, a larger image force is exerted since the protrusion portions are brought into contact with the photosensitive drum surface and many electrified points are localized in regions close to each other. On the contrary, a spherical toner particle like a polymerized toner particle comes into contact with the photosensitive drum surface in the form of a dot, and has less electric charge and receives less image force than the pulverized toner particle. The Van der Waals force is affected by more neighboring regions, and is much greater in a contacting state in a plane.

Figure 5:
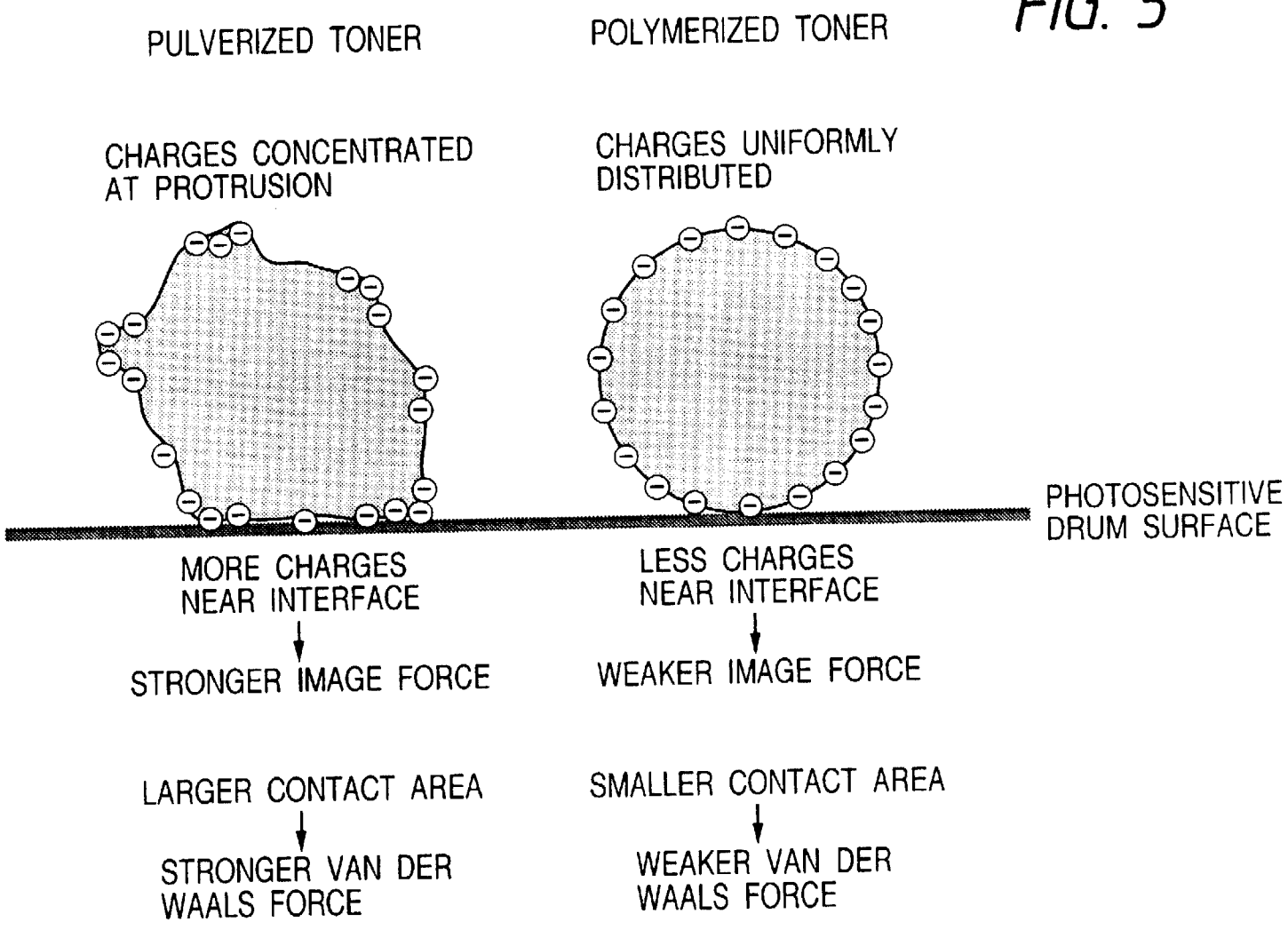
FIG. 5 is a schematic drawing for explaining relation of toner particle shape with an image force and a Van der Waals force.

The toner particles having an irregular surface come into contact with the photosensitive drum surface mostly in a state as shown in FIG. 5, exerting a stronger Van der Waals force. To the contrary, the spherical toner particles having a spherical surface come into contact with the photosensitive drum surface in the form of a dot as shown in FIG. 5, exerting a weaker Van der Waals force.

As described above, the image force and the Van der Waals force are weaker between the spherical toner particles having spherical or nearly spherical surfaces and the photosensitive member, resulting in weaker adhesion. The weaker adhesion makes easy the separation of the toner particles from the photosensitive member to cause less separation discharge. Therefore, such spherical toner is less liable to generate the separation discharge and to cause the toner re-transfer.

Furthermore, the spherical toner which is less adherent to the photosensitive member remains less on the photosensitive member after the toner transfer, and is recovered in a higher recovery efficiency and a higher cleaning efficiency in the development-and-cleaning process.

The spherical toner in the present invention has a shape factor SF-1 ranging from 100 to 180, preferably from 100 to 140, more preferably from 100 to 130, and a shape factor SF-2 ranging from 100 to 140, preferably from 100 to 120, more preferably from 100 to 115.

The shape factors SF-1 and SF-2 in the present invention are measured for 100 toner particles selected at random by means of FE-SEM (Model S-800, Hitachi Ltd.), and the image information is introduced through an interface to an image analysis apparatus (Model Luzex 3, Nireco K.K.) to analyze the image information. The shape factors SF-1 and SF-2 are defined by the equations below:

$$SF-1=\frac{(MXLNG)^2}{\text{AREA}}\times\frac{\pi}{4}\times 100$$

$$SF-2=\frac{(PERI)^2}{\text{AREA}}\times\frac{1}{4\pi}\times 100$$

where AREA is a projected area of toner, MXLNG is absolute maximum length, and PERI is periphery length.

The shape factor SF-1 shows the degree of spherality of the toner. With the increase of the SF-1 value from 180, the shape gradually changes from a spherical shape to an irregular shape. The shape factor SF-2 shows the degree of surface irregularity. At the SF-2 value of 140 or more the surface irregularity becomes remarkable. Therefore, at the SF-1 value of 180 or higher or at the SF-2 value of 140 or higher, the toner re-transfer is possibly not prevented, the transfer efficiency may be lower, fogging may be remarkable, or durability may be lower.

The shape of the toner is designed to reduce the adverse effects of the electrified photosensitive member onto the toner surface, and to retard formation of reactive low-molecular components in the toner. For this purpose, the toner particles are preferably in a sphere shape to have the surface area as small as possible.

The toner which is formed partly or entirely by polymerization achieves higher effects of the present invention. In particular, the toner which has the surface portion formed by polymerization of a pre-toner (or monomer composition) in a dispersion medium can have a sufficiently smooth surface.

In place of the spherical toner produced by the polymerization process as mentioned above, another kind of spherical toner may be used which is produced by heating a pulverized toner prepared by melting, blending, pulverization, and classification, or which is produced by treating a pulverized toner by application of impact to toner particle surface to obtain sphere shape.

A toner of a core/shell structure is also useful for the image-forming apparatus in the present invention. The core/shell type toner can readily be prepared by forming the shell portion by polymerization. Therefore, the toner of the core/shell type is preferably used in the present invention. The core/shell structure results naturally in an antiblocking property of the toner without impairing the fixing property.

The volume-average particle diameter of the toner particles ranges preferably from 4 to 15 μm. The volume-average particle diameter can be measured, for example, by the following method. As the measurement apparatus, Coulter Counter (Model TA-II, Coulter Co.) was used, to which an interface (manufactured by Nikkaki K.K.) and a personal computer CX-i (manufactured by Canon K.K.) were connected for outputting number-average distribution and volume-average distribution. The electrolyte solution employed was an aqueous 1% sodium chloride solution prepared using sodium chloride of first reagent grade. In measurement, to 100 to 150 mL of the above aqueous electrolyte solution, were added 0.1 to 5 mL of a surfactant (preferably an alkylsulfonate salt) as a dispersant, and 0.5 to 50 mg of a sample to be measured. The sample suspended in the electrolyte was dispersed using an ultrasonic dispersion apparatus for about one to three minutes, and then the suspension was subjected to measurement of particle size distribution of 2 to 40 μm particles by the aforementioned Coulter Counter TA-II with an aperture of 100 μm to derive the volume distribution, from which the volume-average particle diameter was obtained.

Further, the toner is preferably coated with an external additive to dissipate the influence of the electrified photosensitive member partially to the external additive. The external additive employed in the present invention has preferably a diameter of not more than one-tenth of the weight-average diameter of the toner particles in view of the durability thereof. The particle diameter of the additive herein means the average diameter measured by surface observation of the toner particles by electron microscopy.

The external additive includes metal oxides such as aluminum oxide, titanium oxide, strontium titanate, cerium oxide, magnesium oxide, chromium oxide, tin oxide, and zinc oxide; nitrides such as silicon nitride; carbides such as silicon carbide; metal salts such as calcium sulfate, barium sulfate, and calcium carbonate; fatty acid metal salts such as zinc stearate and calcium stearate; carbon black, and silica.

The external additive is used in an amount of from 0.01 to 10 parts, preferably from 0.05 to 5 parts by weight to 100 parts by weight of the toner particles. The external additive may be a single substance or a combination of two or more substances. The external additive is preferably treated for hydrophobicity.

Preferred embodiments of the image-forming apparatus of the present invention are described below in more detail by reference to first to third embodiments.

(First Embodiment)

Figure 1:
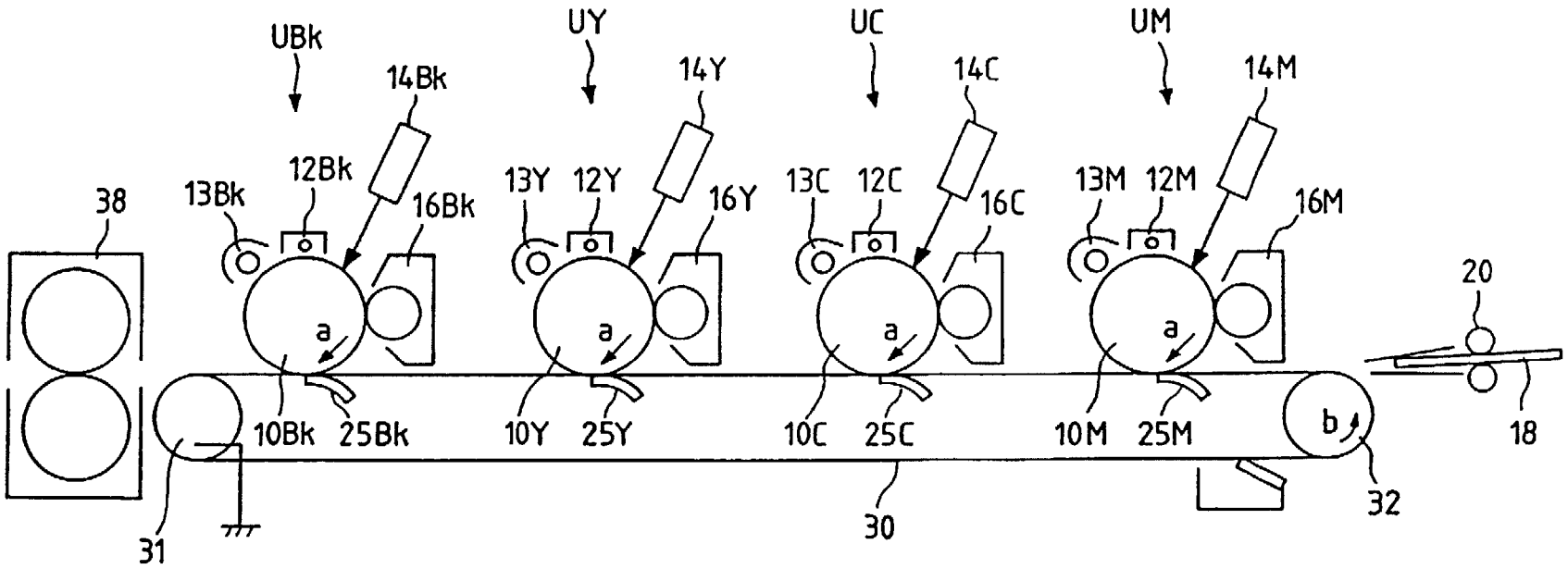
FIG. 1 shows schematically an image-forming apparatus of a first embodiment of the present invention.

FIG. 1 shows schematically an image-forming apparatus of a first embodiment of the present invention.

In FIG. 1, UM indicates an image-forming unit (magenta unit) comprising a developing means which also serves as a cleaning means for recovering and cleaning the toner remaining on the photosensitive drum. After the magenta unit, image-forming units of cyan, yellow, and black are successively arranged, and each of the three units has the same constitution as the magenta unit.

A transfer belt is provided as a delivery means for delivering a toner image-receiving material sheet through the image-forming units. The toner image-receiving material sheet (copying paper sheet) 18 is fed from a paper sheet-feeding section 20. The transfer belt 30 is in contact with a photosensitive drum 10M as a latent image-holder and is driven in a direction shown by an arrow mark. The driving roller 31 and a supporting roller 32 drive the transfer belt 30. An image-fixation device 38 is provided in adjacent to the driving roller 31. A transfer blade 25M is provided as a transfer means in opposition to the photosensitive drum 10M at the image transfer site, and conducts toner image transfer to the image-receiving paper sheet 18 delivered by the transfer belt 30 pinched with the photosensitive drum.

An image is formed in the above constitution as described below.

Firstly, a magenta toner image is formed on the photosensitive drum 10M of the magenta unit UM. The formed magenta toner image is transferred onto the image-receiving paper sheet 18 delivered by the transfer belt 30.

Subsequently, with movement of the transfer belt 30, the image-receiving paper sheet 18 carrying the magenta toner image moves to the cyan unit UC, and there a cyan toner image is transferred onto the image-receiving paper sheet 18 in superposition.

In the same manner, a yellow toner image and a black toner image are formed in superposition onto the image-receiving paper sheet 18 by the yellow unit UY and the black unit UBk. Finally the image is fixed by the fixation device 38 to form an image.

In a four-drum full-color copying machine of the constitution as described above, the image-receiving paper sheet 18 supported by the transfer belt 30 passes successively through the magenta unit UM, the cyan unit UC, the yellow unit UY, and the black unit UBk. In a two-color mode, for example, of magenta and cyan with this four-drum copying machine, only the image forming sections of the necessary magenta and cyan units are required to work. In the two-color mode, unnecessary units (yellow and black units in this case) may be stopped and stand apart from the transfer belt, or may be allowed to run as usual for simplicity of the machine construction.

(Second Embodiment)

Figure 6:
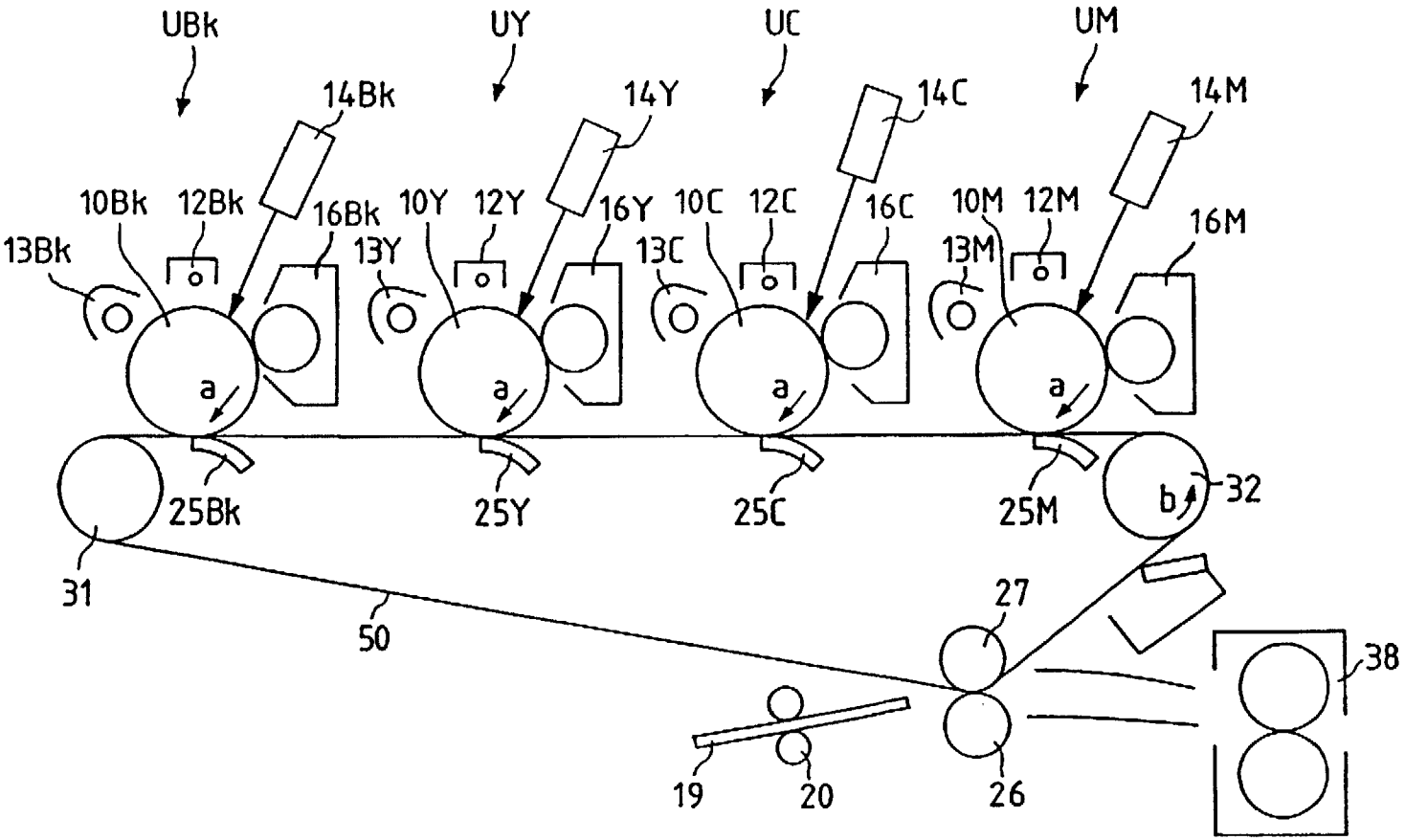
FIG. 6 shows schematically an image-forming apparatus of a second embodiment of the present invention.

FIG. 6 shows schematically an image-forming apparatus of a second embodiment of the present invention.

In this embodiment also, similarly as in the first embodiment, four image-forming units of UM, UC, UY, UBk are provided for respective colors, and each unit is comprised of a photosensitive member (10M, 10C, 10Y, and 10BK), an electrification device (12M, 12C, 12Y, and 12BK), a light exposure device (14M, 14C, 14Y, and 14BK), a development device (16M, 16C, 16Y and 16BK), and a pre-exposure device (13M, 13C, 13Y, and 13BK) arranged integrally around the photosensitive drum member. The employed toners are spherical. An image is formed by a development-and-cleaning process in which the toner on the photosensitive drum member is recovered simultaneously with development.

This second embodiment is different from the first embodiment in which respective color toner images are transferred in superposition on an image-receiving material delivered by a transfer belt, in the point that instead of the transfer belt, an intermediate transfer member 50 is stretched by a driving roller 31, a supporting roller 32, and a back-up roller 27, and respective color toner images are transferred onto this intermediate image-receiving member (primary transfer) in superposition by transfer blades (25M, 25C, 25Y, and 25BK), and the superposed toner image is transferred by means of the back-up roller 27 and the secondary transfer roller 26 onto a copying paper sheet 19 fed by a paper feeding roller 20 as a final image-receiving material, and is fixed thereon by a fixation device 38.

The intermediate transfer member is preferably a flexible endless belt made from a urethane rubber ($10^3$ to $10^4$ Ωcm) having a dielectric surface layer of PTFE (polytetrafluoroethylene) ($10^{14}$ Ωcm or higher). The other constitutional elements of the apparatus are nearly the same as in the first embodiment.

The image formation with the above constitution is described below. Firstly, a magenta toner image is formed on a photosensitive drum of the magenta unit UM by the process shown above. The magenta toner image is transferred primarily onto the intermediate transfer member 50 by a transfer electric field generated by the transfer blade. Then with the rotational movement of the intermediate transfer member, the magenta toner image on the intermediate transfer member 50 is delivered to the subsequent cyan unit, and there a cyan toner image is transferred onto the magenta toner image in superposition (primary transfer). Thereafter, in the same manner as above, charge adjustment and multiple transfer (primary transfer) are conducted in the yellow unit and the black unit. Finally, the superposed toner image is transferred totally onto a copying paper sheet 19 by a secondary transfer roller 26, and is fixed thereon by a fixation device 38 to form an image.

(Third Embodiment)

Figure 7:
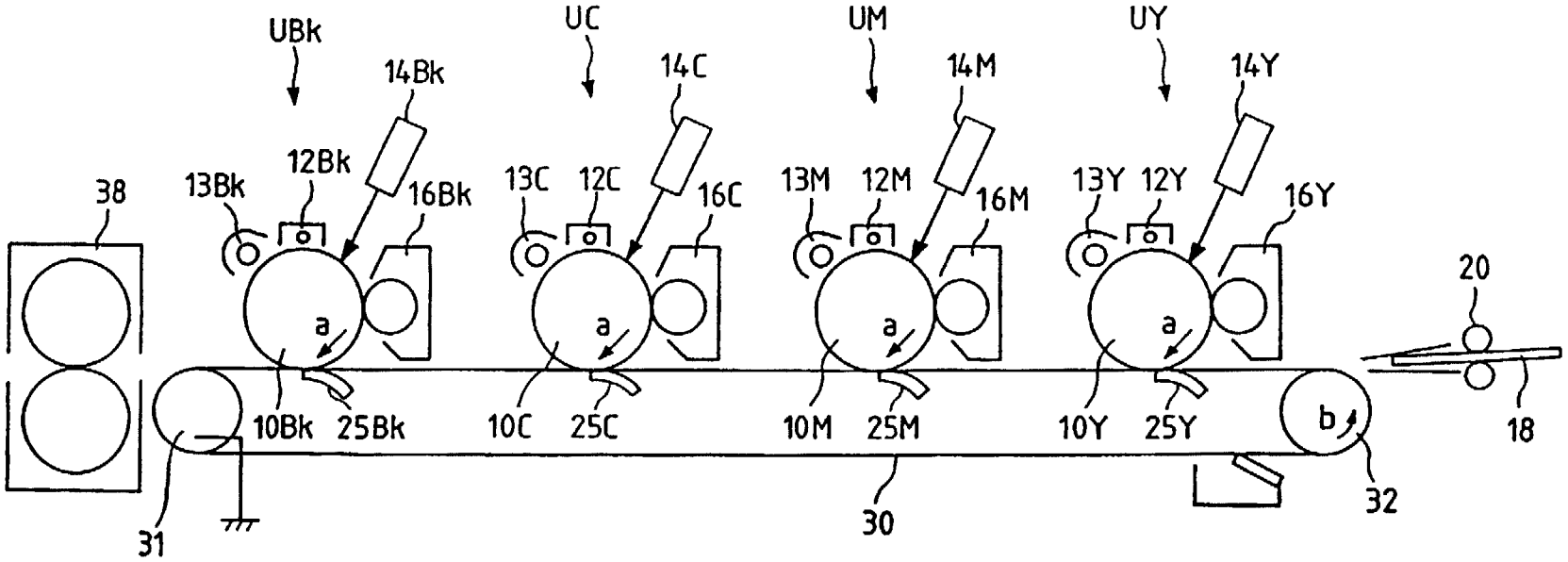
FIG. 7 shows schematically an image-forming apparatus of a third embodiment of the present invention.

FIG. 7 shows schematically an image-forming apparatus of a third embodiment of the present invention.

In this embodiment also, similarly as in the first embodiment, four image-forming units of UM, UC, UY, UBk are provided for respective colors, and each unit is comprised of a photosensitive drum (10Y, 10M, 10C, and 10BK), an electrification device (12Y, 12M, 12C, and 12BK), a light exposure device (14Y, 14M, 14C, and 14BK), a development device (16Y, 16M, 16C, 16BK), and a pre-exposure device (13Y, 13M, 13C, and 13BK), those being arranged integrally around the photosensitive drum member. However, characteristically in this embodiment, the color units are arranged in the order of the yellow unit UY, the magenta unit UM, the cyan unit UC, and the black unit UBk.

This order of arrangement of the image-forming units is selected in consideration of the characteristics in chromaticity change caused by contamination of the color toner with a different color toner such that the chromaticity changes in the respective color image-forming units are minimized. Thereby, the change of the chromaticity due to color toner contamination is minimized.

The image-forming apparatus of this embodiment comprises plural image-forming units which are arranged in the aforementioned order and have respectively a development device for conducting toner recovery and cleaning as well as image development. This image-forming apparatus in combination with a spherical toner and an image-holding member having a surface of a contact angle with water of not less than 85° can maintain the advantage of an image-forming apparatus in which toner re-transfer is inhibited, namely less color contamination and less disturbance of color balance, after running on much more sheets.

Figure 8:
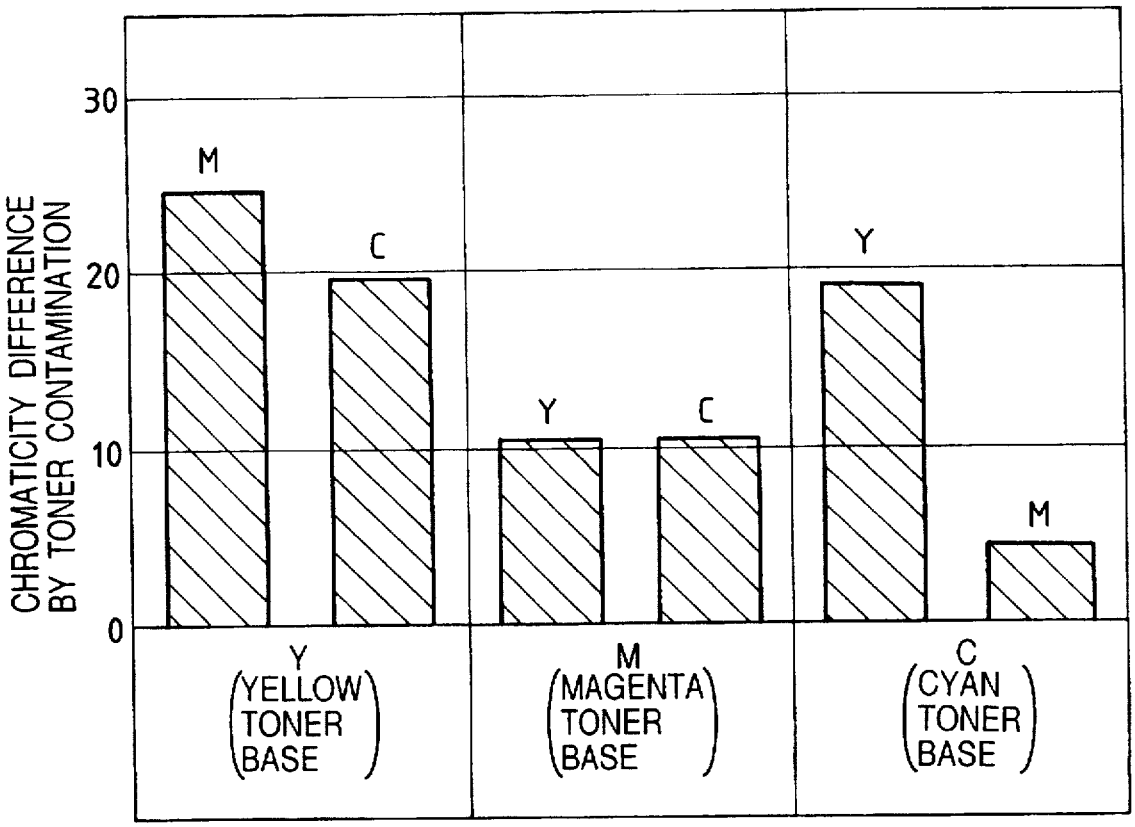
FIG. 8 is a chart for explaining change of chromaticity on mixing a magenta toner, a yellow toner, and a cyan toner.

The chromaticity change caused by contamination of a different color toner is explained below. The chromaticity change due to the contamination of another color toner depends not only on the kind of the contaminating color toner but also on the kind of the contaminated color toner. FIG. 8 shows the change of chromaticity caused by the contamination of a different color toner in an amount of 7% by weight using a yellow toner, a magenta toner, and a cyan toner as the base toner. The change of chromaticity of the yellow base toner due to the contamination with the magenta toner or the cyan toner is larger than that of the magenta base toner or the cyan base toner. Therefore, the largest change of chromaticity due to the contamined yellow toner with a different color toner is prevented by arranging the yellow image-forming unit at the first position in the transfer belt movement direction, the only place where the color mixing does not occur in principle.

Figure 9:
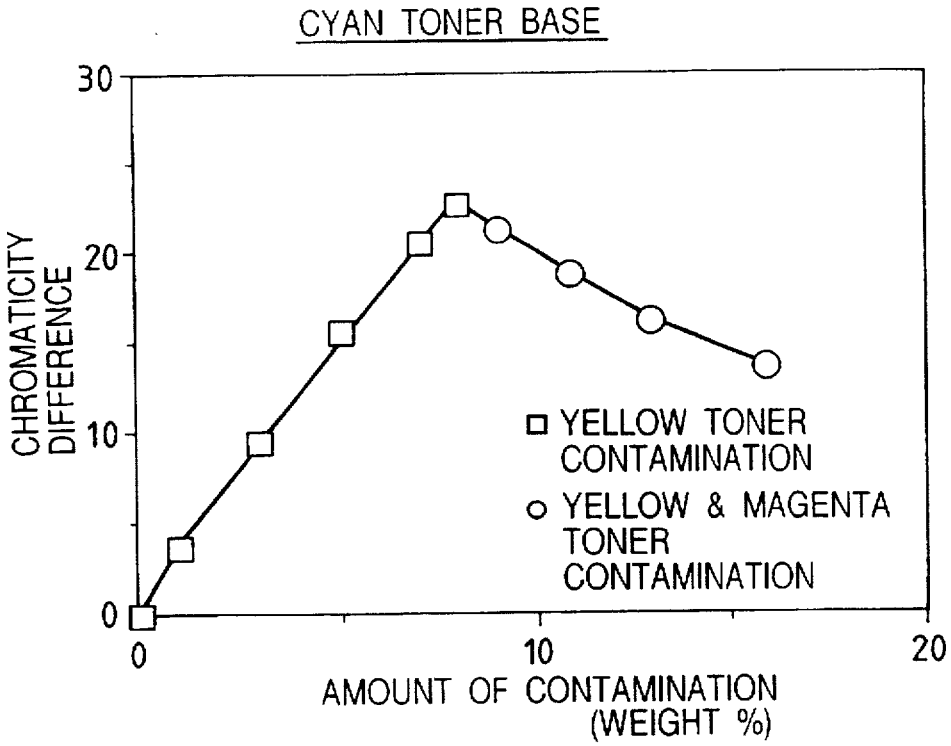
FIG. 9 is a chart for explaining change of chromaticity when a yellow toner and a magenta toner are mixed to a cyan toner.
Figure 10:
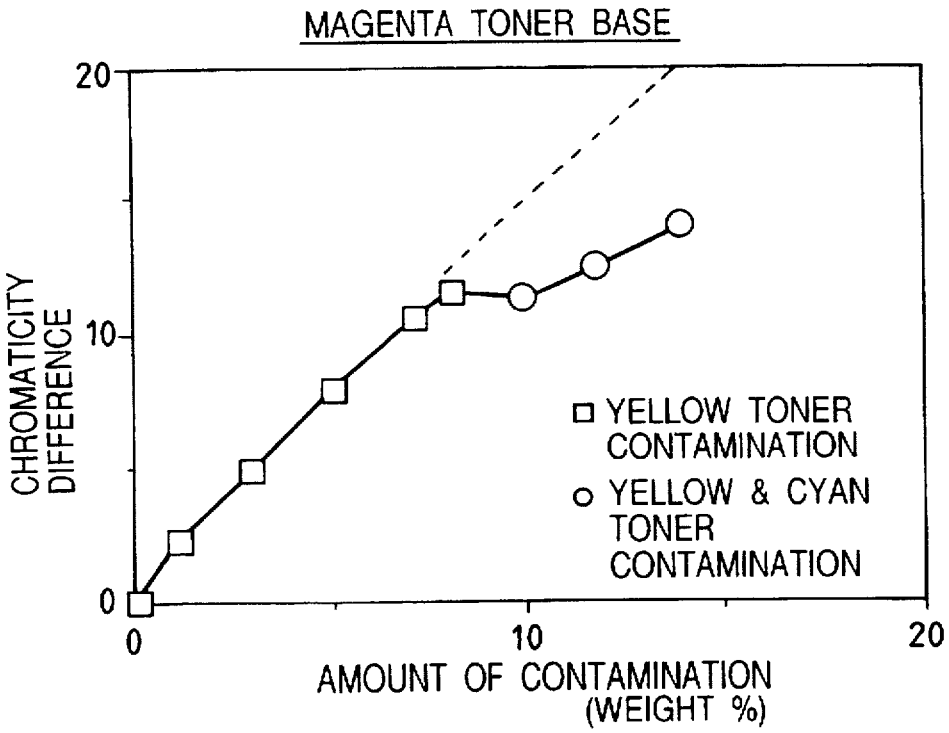
FIG. 10 is a chart for explaining change of chromaticity when a yellow toner and a cyan toner are mixed to a magenta toner.

The second largest chromaticity change by the color toner contamination is that caused by the contamination of the cyan base toner with the yellow toner. When the cyan image-forming unit is placed at the second position or next to the yellow image-forming unit, only the yellow toner contaminates the cyan image forming unit. When the cyan image-forming unit is placed at the third position, the cyan image-forming unit is obviously contaminated by the yellow toner and the cyan toner. FIG. 9 shows the change of chromaticity of the cyan base toner contaminated with the two color toners of yellow and magenta. From FIG. 9, it is understood that the chromaticity change of the cyan base toner caused by contamination with both the magenta toner and the yellow toner is smaller than that caused by the yellow toner solely. FIG. 10 shows the change of chromaticity of the magenta base toner contaminated with the two color toners of yellow and cyan. In this case, the chromaticity change is not increased by the contamination with the second color toner, but the chromaticity change is not lowered. Accordingly, to minimize the chromaticity change in the respective image-forming unit, preferably the magenta image-forming unit is placed at the second position, and the cyan image-forming unit is placed at the third position.

The fourth image-forming unit is contaminated with the toners of yellow, magenta, and cyan by toner re-transfer. The mixture of these three colors is generally known to give blackish color owing to subtractive color mixing characteristics. Therefore, contamination of the black base toner with these toner is little perceived visually. Consequently, the change of chromaticity by toner contamination is minimized by placing the black image-forming unit at the fourth.

As explained above, the chromaticity change of the output image caused by toner contamination is minimized by arranging the respective color image-forming units in the order of yellow, magenta, cyan, and black in the direction of delivery of the image-receiving material.

The image-forming apparatus comprises at least a first image-forming unit and a second image-forming unit, and the second image-forming unit has a developing means which serves also as a cleaning means to recover the toner left on the image-forming unit after transfer from a latent image-holding member and to clean the latent image-holding member, where the surface of the latent image-holding member of the second image-forming unit has a contact angle for water of not less than 85°. Thereby, the toner of a first toner image transferred to an image-receiving member is less liable to cause re-transfer onto the second latent image-holding member when a second toner image is transferred onto the transferred image-receiving member.

Consequently, the contamination of the second developing means by the first toner is suppressed to reduce disturbance of the color balance and to minimize the change of chromaticity in the course of many sheets of image formation.

The image-forming apparatus of the present invention is described below in more detail by reference to examples without limiting the invention in any way.

[EXAMPLES]

Preparation of Cyan Toner A

A monomer composition composed of a polymerizable monomer and a cyan coloring agent was dispersed and suspended in an aqueous medium by agitation, and the resulting suspended particulate monomer was polymerized to obtain a cyan toner A.

The obtained cyan toner A had a weight-average particle diameter of 8 μm, SF-1 of 108, and SF-2 of 108, and was spherical in shape.

Preparation of Magenta Toner A, Yellow Toner A, and Black Toner A

A magenta toner A, a yellow toner A, and a black toner A were prepared in the same manner as in the aforementioned preparation of the cyan toner A except for using a magenta coloring agent, a yellow coloring agent, or a black coloring agent respectively in place of the cyan coloring agent. The properties of the toners are shown in Table 1.

Preparation of Cyan Toners B and C

A binder resin and a cyan coloring agent were melted, blended, pulverized and classified to obtain a pulverized cyan toner B. The obtained pulverized cyan toner B had a weight-average particle diameter of 8 μm, SF-1 of 150, and SF-2 of 145, and was non-spherical in shape.

The pulverized cyan toner B was heat-treated to make the particle shape spherical to obtain a cyan toner C. The obtained pulverized cyan toner C had a weight-average particle diameter of 8 μm, SF-1 of 110, and SF-2 of 110, and was spherical in shape.

Preparation of Magenta Toners B and C, Yellow Toners B and C, and Black Toners B and C Magenta toners B and C, yellow toners B and C, and black toners B and C were prepared in the same manner as preparation of the cyan toners B and C except for using a magenta coloring agent, a yellow coloring agent, or a black coloring agent respectively in place of the cyan coloring agent. The properties of the toners are shown in Table 1.

Preparation of Cyan Toners D–F

Polymerized cyan toners D, E, and F were prepared in the same manner as in preparation of the cyan toner A except that the agitation conditions of the monomer composition in the aqueous medium was changed. The properties of the toners are shown in Table 1.

Preparation of Magenta Toners D–F

Polymerized magenta toners D, E, and F were prepared in the same manner as in preparation of the magenta toner A except that the agitation conditions of the monomer composition in the aqueous medium was changed. The properties of the toners are shown in Table 1.

Preparation of Yellow Toners D–F

Polymerized yellow toners D, E, and F were prepared in the same manner as in preparation of the yellow toner A except that the agitation conditions of the monomer composition in the aqueous medium was changed. The properties of the toners are shown in Table 1.

Preparation of Black Toners D–F

Polymerized black toners D, E, and F were prepared in the same manner as in preparation of the black toner A except that the agitation conditions of the monomer composition in the aqueous medium was changed. The properties of the toners are shown in Table 1.

Preparation of Cyan Toner G

A cyan toner G was prepared by heat-treating the aforementioned cyan toner B in the same manner as in preparation of the cyan toner C except for changing the heat-treatment time shorter than in preparation of the cyan toner C. The properties of the toner are shown in Table 1.

Preparation of Magenta Toner G

A magenta toner G was prepared by heat-treating the aforementioned magenta toner B in the same manner as in preparation of the magenta toner C except for changing the heat-treatment time shorter than in preparation of the magenta toner C. The properties of the toner are shown in Table 1.

Preparation of Yellow Toner G

A yellow toner G was prepared by heat-treating the aforementioned yellow toner B in the same manner as in preparation of the yellow toner C except for changing the heat-treatment time shorter than in preparation of the yellow toner C. The properties of the toner are shown in Table 1.

Preparation of Black Toner G

A black toner G was prepared by heat-treating the aforementioned black toner B in the same manner as in preparation of the black toner C except for changing the heat-treatment time shorter than in preparation of the black toner C. The properties of the toner are shown in Table 1.

Production of Photosensitive Drum Member A

On a base aluminum drum of 30 mm in diameter, was formed a subbing layer of 20 μm thick as the first layer which is an electroconductive layer for preventing occurrence of moire by reflection of projected light. Thereon, a positive charge injection layer was formed as the second layer, which prevents neutralization of the negative charge on the photosensitive member surface by the positive charge injected from the base drum, and was a medium resistance layer formed from an amylan resin and a methoxymethylated nylon, having an adjusted resistivity of about $10^6$ Ωcm and a thickness of about 0.1 μm. Thereon, a charge-generating layer of about 0.3 μm thick was formed as the third layer, which is composed of a resin and a disazo type pigment dispersed therein, for generating positive and negative electron pairs on irradiation of light. A charge-transporting layer was formed thereon as the fourth layer, which is a p-type semiconductor composed of a polycarbonate resin and a hydrazone dispersed therein. Further, a surface layer of 2 μm thick was formed as the fifth layer which is composed of a polycarbonate resin. The surface of this photosensitive drum member A had a contact angle for water of 80°.

Production of Photosensitive Drum Members B–F

Photosensitive drum members B to F were produced in the same manner as in production of the photosensitive drum member A except that the surface layers were formed in a thickness of 2 μm from a polycarbonate resin containing Teflon (trade name, DuPont Co.) respectively in an amount of 2 parts by weight (photosensitive member B), 5 parts by weight (photosensitive member C), 7 parts by weight (photosensitive member D), 10 parts by weight (photosensitive member E), and 11 parts by weight (photosensitive member F) in 100 parts by weight of the polycarbonate resin. The surface of the photosensitive drum members B to F had a contact angle for water respectively of 85° (photosensitive member B), 92° (photosensitive member C), 95° (photosensitive member D), 100° (photosensitive member E), and 103° (photosensitive member F).

Production of Photosensitive Drum Member G

A photosensitive drum member G was prepared in the same manner as the photosensitive drum member A except that the fifth layer as the surface layer was formed from a photo-curable acrylic resin. The contact angle for water of this photosensitive drum member G was 82°.

Production of Photosensitive Drum Members H and I

Photosensitive drum members H and I were prepared in the same manner as the photosensitive drum member G except that the fifth layer as the surface layer was formed respectively from a composition composed of 100 parts by weight of a photo-curable acrylic resin, and 200 parts by weight of $SnO_2$ and 30 parts by weight (drum member H) or 35 parts by weight (drum member I) of a particulate fluororesin like Teflon dispersed therein. The contact angles for water of the photosensitive drum members H and I were 102°, and 103°, respectively.

Example 1

Four two-component type developer were prepared by mixing respectively a cyan toner A, a magenta toner A, a yellow toner A, or a black toner A with a carrier. The photosensitive drum members B were mounted on an image-forming apparatus of the first embodiment shown in FIG. 1. Continuous running test of image-formation of 70000 sheets was conducted with the above four developing agents with the above apparatus under the development conditions and the transfer conditions below. The evaluations were made regarding the re-transfer ratio, the chromaticity change caused by toner contamination, and the chromaticity of the full-color image. The toner remaining on the photosensitive drum members after the image transfer was recovered at the development by using a magnetic brush constituted of the toner and a carrier in the development device to perform the cleaning.

Development conditions

AC bias: $V_{PP}$=2 KV, f=2 KHz

DC component: Development bias of rectangular shape of $V_{DC}$=−500V

Transfer conditions

Voltage of +2.0 KV was applied to each of the transfer blades.

The evaluation results are shown in Table 2. The re-transfer ratios were low. High quality of images were obtained with less image deterioration, less density decrease and less color balance disturbance. The color toner contamination was suppressed at the development and simultaneous toner recovery in the development device. The consumption of the cyan toner was 0.05 g per sheet (A4), which is less by about 8% than a conventional apparatus employing a cleaner. The re-transfer ratio was 3.5% at the initial stage, and 6.5% after 70000-sheet running test. Further, the chromaticity change of cyan single color caused by contamination with the magenta color toner by re-transfer was 8 in terms of color difference. The chromaticity change about 8 does not affect adversely the color reproduction.

The re-transfer ratio of the toner, the chromaticity change of the single color image, and chromaticity of the full-color image were measured as described below.

(1) Re-transfer ratio

A solid magenta image is formed by the first color-image forming unit (magenta unit), and is transferred onto an image-receiving material sheet. The transferred magenta toner of the solid magenta image is collected from the image-receiving material sheet by means of a suction apparatus provided with a filter. The amount ($W_1$) of the collected magenta toner (transferred magenta toner) is weighed.

Separately, the same solid magenta image is formed by the first color-image forming unit (magenta unit), and is transferred onto another image-receiving material sheet. Then, a blank image (namely, no image) is formed in the second color image-forming unit (cyan unit). In this state, no cyan toner image is formed on the photosensitive drum. This solid blank image is transferred onto the solid magenta image having been transferred on the image-receiving material sheet (practically only the operation of transfer is conducted since no cyan toner has been formed). After the transfer operation of the second color, the magenta toner (re-transferred) on the photosensitive drum member of the second image-forming unit is collected by means of a suction apparatus provided with a filter. The amount ($W_2$) of the collected magenta toner (re-transferred magenta toner) is weighed.

The re-transfer ratio (RTR) of the magenta toner is derived from the weight ($W_1$) of the transferred magenta toner and the weight ($W_2$) of the re-transferred magenta toner by the equation below. The re-transfer is evaluated by the evaluation standard below.

$$RTR(\%)=[(W_2)/(W_1)]\times 100$$

Evaluation standard

RTR<5.0: substantially no re-transfer 5.0≦RTR<7.0: little re-transfer 7.0≦RTR<8.0: slight re-transfer 8.0≦RTR<9.0: remarkable re-transfer 9.0≦RTR : serious re-transfer (2) Chromaticity change of single color image The chromaticity change of the single color image caused in the cyan color image was evaluated by the color difference (ΔE), which is caused by re-transfer of the magenta toner of the magenta unit (the first image-forming unit) onto the photosensitive drum of the cyan unit (second image-forming unit). The color difference (ΔE) is derived from the color data (lightness (L*) and chromaticity (a*, b*)) obtained by means of X-Rite 404 (X-Rite Co.) by the equation below. The chromaticity change is evaluated according to the evaluation standard below.

$$\Delta E=\{(L_1^*-L_2^*)^2+(a_1^*-a_2^*)^2+(b_1^*-b_2^*)^2\}^{1/2}$$

where $L_1^*$, $a_1^*$, and $b_1^*$ are the color data of the original image, and $L_2^*$, $a_2^*$, and $b_2^*$ are the color data of the copied image.

Evaluation standard $\Delta E \leqq 6.0$: Excellent $6.0 < \Delta E \leqq 8.0$: Very good $8.0 < \Delta E \leqq 10.0$: Good $10.0 < \Delta E \leqq 12.0$: Fair $12.0 < \Delta E$: Poor (3) Evaluation of full-color image The evaluation of the chromaticity of a full-color image corresponds to chromaticity changes of single colors. The color reproduction was evaluated by the degree of precision of the reproduction of the original image in the copied image according to the evaluation standard below:

A: The original image is precisely reproduced.

B: The original image is approximately reproduced.

C: The color balance is slightly disturbed, but is sufficient in practical use.

D: The color balance is slightly disturbed.

E: The color balance is remarkably disturbed.

Examples 2–18 and Comparative Examples 1–7

Images were formed and the formed images were evaluated in the same manner as in Example 1 except for using color toners shown in Table 1 in place of the cyan toner A, the magenta toner A, the yellow toner A, and the black toner A, and photosensitive drum members shown in Table 2 in place of the photosensitive drum members B. The evaluation results are shown in Table 2.

Comparative Example 8

A cleaning device having a cleaning blade was provided so as to be in contact with the surface of the photosensitive drum member on the image-forming member of the first embodiment as shown in FIG. 1 and employed in Example 1. With this image-forming apparatus, images were formed with by recovering of the toner by the cleaning blade. The consumption of the cyan toner was 0.055 g per sheet (A4), which is more by 8% than that in Example 1.

Example 19

Image formation of 70000 sheets was conducted by using an image-forming apparatus of the second embodiment as shown in FIG. 6 with the photosensitive drum members F having a contact angle for water of 103° and with the polymerized toners A under the development conditions and the primary transfer conditions below. The toner remaining on each of the photosensitive drum members after the image transfer was recovered at the development device by using a magnetic brush constituted of the toner and a carrier in the development device.

Development conditions

AC bias: $V_{PP}$=2 KV, f=2 KHz

DC component: Development bias of rectangular shape of $V_{DC}$=−500 V

Primary transfer conditions

Voltage of +2.0 KV was applied to each of the transfer blades.

As the results, high quality of images were obtained without image defects caused by re-transfer. The color toner contamination was suppressed at the development and simultaneous toner recovery in the development device. The color balance of the full-color image after many-sheet running test was disturbed little as composed with that of the initial full-color image.

Example 20

Image formation was conducted by using an image-forming apparatus of the third embodiment as shown in FIG. 7, which is different in the order of the color image-forming units. The spherical polymerized color toners A and the photosensitive drum members F of a contact angle for water of 103° were used as in Example 5. The development conditions and the transfer conditions were the same as in Example 5. Even after 100000-sheet running test of full-color image formation, the change of chromaticity was less and the color balance was disturbed less than those in Example 5, as shown in Table 3.

Example 21

From the image-forming apparatus used in Example 1, the black unit was dismounted to provide an image-forming unit of three colors of cyan, magenta, and yellow. With this apparatus, full-color images were formed in the same manner as in Example 1 without the black unit. As the results, satisfactory images were formed although the reproducibility of black color like black letters was slightly lower than that in Example 1.

TABLE 1

| | Toner production process | Weight-average molecular weight (μm) | SF-1 | SF-2 |
|---|---|---|---|---|
| Cyan toner A | Polymerization | 8.0 | 108 | 108 |
| Magenta toner A | Polymerization | 8.0 | 108 | 108 |
| Yellow toner A | Polymerization | 8.0 | 108 | 108 |
| Black toner A | Polymerization | 8.0 | 108 | 108 |
| Cyan toner B | Pulverization | 8.0 | 150 | 145 |
| Magenta toner B | Pulverization | 8.0 | 150 | 145 |
| Yellow toner B | Pulverization | 8.0 | 150 | 145 |
| Black toner B | Pulverization | 8.0 | 150 | 145 |
| Cyan toner C | Pulverization & heat treatment | 8.0 | 110 | 110 |
| Magenta toner C | Pulverization & heat treatment | 8.0 | 110 | 110 |
| Yellow toner C | Pulverization & heat treatment | 8.0 | 110 | 110 |
| Black toner C | Pulverization & heat treatment | 8.0 | 110 | 110 |
| Cyan toner D | Polymerization | 6.0 | 108 | 108 |
| Magenta toner D | Polymerization | 6.0 | 108 | 108 |
| Yellow toner D | Polymerization | 6.0 | 108 | 108 |
| Black toner D | Polymerization | 6.0 | 108 | 108 |
| Cyan toner E | Polymerization | 8.0 | 120 | 115 |
| Magenta toner E | Polymerization | 8.0 | 120 | 115 |
| Yellow toner E | Polymerization | 8.0 | 120 | 115 |
| Black toner E | Polymerization | 8.0 | 120 | 115 |
| Cyan toner F | Polymerization | 8.0 | 130 | 125 |
| Magenta toner F | Polymerization | 8.0 | 130 | 125 |
| Yellow toner F | Polymerization | 8.0 | 130 | 125 |
| Black toner F | Polymerization | 8.0 | 130 | 125 |
| Cyan toner G | Pulverization & heat treatment | 8.0 | 145 | 130 |
| Magenta toner G | Pulverization & heat treatment | 8.0 | 145 | 130 |
| Yellow toner G | Pulverization & heat treatment | 8.0 | 145 | 130 |
| Black toner G | Pulverization & heat treatment | 8.0 | 145 | 130 |

TABLE 2

| | Two-component developer toner | | | | | | Photosensitive member drum | | Initial stage | | | 50000-Sheet running test | | | 70000-Sheet running test | | |
|---|---|---|---|---|---|---|---|---|---|---|---|---|---|---|---|---|---|
| | Cyan toner | Magenta toner | Yellow toner | Black toner | SF-1 | SF-2 | Photosensitive drum | Contact angle to water | Re-transfer ratio (%) | Chromaticity change of single cyan color | Evaluation of chromaticity of full-color image | Re-transfer ratio (%) | Chromaticity change of single cyan color | Evaluation of chromaticity of full-color image | Re-transfer ratio (%) | Chromaticity change of single cyan color | Evaluation of chromaticity of full-color image |
| Example: | | | | | | | | | | | | | | | | | |
| 1 | A | A | A | A | 108 | 108 | B | 85 | 3.5 | 4.2 | A | 4.8 | 5.7 | B | 6.5 | 8.0 | C |
| 2 | A | A | A | A | 108 | 108 | C | 92 | 3.2 | 3.8 | A | 4.5 | 5.5 | B | 6.0 | 7.2 | C |
| 3 | A | A | A | A | 108 | 108 | D | 95 | 3.0 | 3.6 | A | 4.0 | 4.7 | B | 5.5 | 6.7 | B |
| 4 | A | A | A | A | 108 | 108 | E | 100 | 1.0 | 1.2 | A | 1.8 | 2.0 | A | 2.0 | 2.4 | A |
| 5 | A | A | A | A | 108 | 108 | F | 103 | 0.2 | 0.2 | A | 0.5 | 0.7 | A | 0.9 | 1.2 | A |
| 6 | B | B | B | B | 150 | 145 | B | 85 | 5.7 | 6.7 | B | 7.5 | 8.0 | C | 8.5 | 10.1 | E |
| 7 | B | B | B | B | 150 | 145 | F | 103 | 5.2 | 6.3 | B | 6.8 | 7.8 | C | 8.0 | 9.0 | D |
| 8 | C | C | C | C | 110 | 110 | B | 85 | 4.0 | 4.8 | B | 4.9 | 5.9 | B | 5.5 | 6.0 | B |
| 9 | C | C | C | C | 110 | 110 | E | 100 | 1.0 | 1.2 | A | 1.5 | 1.8 | A | 1.8 | 2.1 | A |
| 10 | C | C | C | C | 110 | 110 | F | 103 | 0.5 | 0.6 | A | 0.8 | 0.8 | A | 1.0 | 1.3 | A |
| 11 | D | D | D | D | 108 | 108 | H | 102 | 0.7 | 0.8 | A | 1.0 | 1.3 | A | 1.2 | 1.5 | A |
| 12 | D | D | D | D | 108 | 108 | I | 103 | 0.2 | 0.2 | A | 0.8 | 1.0 | A | 1.0 | 1.2 | A |
| 13 | E | E | E | E | 120 | 115 | H | 102 | 2.0 | 2.4 | A | 3..0 | 3.7 | A | 3.5 | 4.4 | B |
| 14 | F | F | F | F | 130 | 125 | H | 102 | 3.0 | 3.5 | A | 3.5 | 4.3 | A | 4.2 | 5.0 | B |
| 15 | G | G | G | G | 145 | 130 | B | 85 | 4.7 | 5.6 | B | 6.5 | 8.0 | C | 8.0 | 9.3 | D |
| 16 | G | G | G | G | 145 | 130 | D | 95 | 4.5 | 5.5 | B | 6.2 | 7.5 | C | 7.5 | 8.9 | D |
| 17 | G | G | G | G | 145 | 130 | E | 100 | 4.5 | 5.4 | B | 6.0 | 7.4 | C | 7.2 | 8.6 | C |
| 18 | G | G | G | G | 145 | 130 | F | 103 | 4.0 | 4.7 | B | 5.5 | 6.3 | B | 7.0 | 8.0 | C |
| Comparative Example: | | | | | | | | | | | | | | | | | |
| 1 | A | A | A | A | 108 | 108 | A | 80 | 6.0 | 7.0 | C | 8.0 | 9.6 | D | 9.0 | 11.0 | E |
| 2 | B | B | B | B | 150 | 145 | A | 80 | 9.0 | 11.0 | E | 12.0 | 14.0 | E | 15.0 | 18.0 | E |
| 3 | C | C | C | C | 110 | 110 | A | 80 | 7.0 | 8.5 | C | 9.0 | 11.0 | E | 10.0 | 12.3 | E |
| 4 | D | D | D | D | 108 | 108 | G | 82 | 5.5 | 6.5 | B | 7.5 | 8.9 | D | 8.0 | 9.6 | D |
| 5 | E | E | E | E | 120 | 115 | G | 82 | 6.0 | 7.3 | C | 8.0 | 9.5 | D | 9.0 | 10.9 | E |
| 6 | F | F | F | F | 130 | 125 | G | 82 | 8.0 | 9.6 | D | 11.0 | 13.0 | E | 14.0 | 17.2 | E |
| 7 | G | G | G | G | 145 | 130 | A | 80 | 8.5 | 10.0 | D | 11.0 | 12.9 | E | 14.0 | 16.9 | E |

TABLE 3

| | Initial stage Evaluation of chromaticity of full-color image | 100000-Sheet running test Evaluation of chromaticity of full-color image |
|---|---|---|
| Example 5 | A | B |
| Example 20 | A | A |

What is claimed is:

1. An image forming apparatus comprising at least:

a first image-forming unit comprising a first latent image-holding member for holding a first electrostatic latent image, a first latent image-forming means for forming the first electrostatic latent image on the first latent image-holding member, a first developing means for developing the first electrostatic latent image on the first latent image-holding member with a first toner to form a first toner image on the first latent image-holding member, and a first image-transfer means for transferring the first toner image from the first latent image-holding member onto an image-receiving member; and a second image-forming unit comprising a second latent image-holding member for holding a second electrostatic latent image, a second latent image-forming means for forming a second electrostatic latent image on the second latent image-holding member, a second developing means for developing the second electrostatic latent image on the second latent image-holding member with a second toner to form a second toner image on the second latent image-holding member, and a second image-transfer means for transferring the second toner image from the second latent image-holding member onto the image-receiving member holding the first toner image having been formed thereon by the first image-forming unit, the second developing means also serving as a cleaning means for recovering the toner remaining on the second latent image-holding member after the image transfer to perform cleaning, wherein the second latent image-holding member has a surface having a contact angle for water of not less than 85°.

2. The image-forming apparatus according to claim 1, wherein the contact angle for water of the surface of the second latent image-holding member is not less than 90°.

3. The image-forming apparatus according to claim 1, wherein the contact angle for water of the surface of the second latent image-holding member is not less than 100°.

4. The image-forming apparatus according to claim 1, wherein the second latent image-holding member is formed from a photosensitive member.

5. The image-forming apparatus according to claim 4, wherein the photosensitive member has a surface layer composed of a base resin and a fluoro-resin dispersed in the base resin.

6. The image-forming apparatus according to claim 5, wherein the surface layer contains the fluoro-resin in an amount ranging from 1 to 150 parts by weight for 100 parts by weight of the base resin.

7. The image-forming apparatus according to claim 5, wherein the surface layer contains the fluoro-resin in an amount ranging from 5 to 100 parts by weight for 100 parts by weight of the base resin.

8. The image-forming apparatus according to claim 1, wherein the first toner has shape factors of SF-1 ranging from 100 to 180 and SF-2 ranging from 100 to 140.

9. The image-forming apparatus according to claim 8, wherein the first toner is prepared by polymerizing a monomer composition containing at least a polymerizable monomer and a coloring agent in a dispersion medium.

10. The image-forming apparatus according to claim 8, wherein the first toner is prepared by melting, blending, pulverizing, and classifying a toner material containing at least a binder resin, and a coloring agent, and treating the classified toner for making the toner spherical in particle shape.

11. The image-forming apparatus according to claim 1, wherein the first toner has shape factors of SF-1 ranging from 100 to 130 and SF-2 ranging from 100 to 120.

12. The image-forming apparatus according to claim 1, wherein the first toner is spherical in particle shape.

13. The image-forming apparatus according to claim 1, wherein the second toner has shape factors of SF-1 ranging from 100 to 180 and SF-2 ranging from 100 to 140.

14. The image-forming apparatus according to claim 13, wherein the second toner is prepared by polymerizing a monomer composition containing at least a polymerizable monomer and a coloring agent in a dispersion medium.

15. The image-forming apparatus according to claim 13, wherein the second toner is prepared by melting, blending, pulverizing, and classifying a toner material containing at least a binder resin, and a coloring agent, and treating the classified toner for making the toner spherical in particle shape.

16. The image-forming apparatus according to claim 1, wherein the second toner has shape factors of SF-1 ranging from 100 to 130 and SF-2 ranging from 100 to 120.

17. The image-forming apparatus according to claim 1, wherein the second toner is spherical in shape.

18. The image-forming apparatus according to claim 1, wherein the first toner has shape factors of SF-1 ranging from 100 to 180 and SF-2 ranging from 100 to 140, and the second toner has shape factors of SF-1 ranging from 100 to 180 and SF-2 ranging from 100 to 140.

19. The image-forming apparatus according to claim 18, wherein the first toner is prepared by polymerizing a first monomer composition containing at least a first polymerizable monomer and a first coloring agent in a dispersion medium, and the second toner is prepared by polymerizing a second monomer composition containing at least a second polymerizable monomer and a second coloring agent in a dispersion medium.

20. The image-forming apparatus according to claim 18, wherein the first toner is prepared by melting, blending, pulverizing, and classifying a first toner material containing at least a first binder resin, and a first coloring agent, and treating the classified first toner for making the first toner spherical in particle shape; and the second toner is prepared by melting, blending, pulverizing, and classifying a first toner material containing at least a second binder resin, and a second coloring agent, and treating the classified second toner for making the second toner spherical in particle shape.

21. The image-forming apparatus according to claim 18, wherein the first toner is spherical, and the second toner is spherical.

22. The image-forming apparatus according to claim 1, wherein the first toner has shape factors of SF-1 ranging from 100 to 130 and SF-2 ranging from 100 to 120, and the second toner has shape factors of SF-1 ranging from 100 to 130 and SF-2 ranging from 100 to 120.

23. The image-forming apparatus according to claim 1, wherein the first toner is spherical, and the second toner is spherical.

24. The image-forming apparatus according to claim 1, wherein the second toner comprises toner particles and an external additive.

25. The image-forming apparatus according to claim 1, wherein the second developing means has a two-component developer composed of the second toner and a carrier, and the second electrostatic latent image on the second latent image-holding member is developed by the second toner of a magnetic brush formed from the two-component developer, contacting with second latent image-holding member and by the second toner flying from the magnetic brush.

26. The image-forming apparatus according to claim 25, wherein a development bias can be applied to the second developing means.

27. The image-forming apparatus according to claim 1, wherein the image-receiving member is a recording material.

28. The image-forming apparatus according to claim 1, wherein the image-receiving member is constituted of an intermediate image-receiving member, and the image-forming apparatus comprises a secondary transfer means for secondarily transferring the first toner image and the second toner image transferred on the intermediate image-receiving member entirely onto a recording material.

29. The image-forming apparatus according to claim 1, further comprising a third image-forming unit comprising a third latent image-holding member for holding a third electrostatic latent image, a third latent image-forming means for forming the third electrostatic latent image on the third latent image-holding member, a third developing means for developing the third electrostatic latent image on the third latent image-holding member with a third toner to form a third toner image on the third latent image-holding member, and a third image-transfer means for transferring the third toner image from the third latent image-holding member onto the image-receiving member holding the first toner image having been formed thereon by the first image-forming unit and the second toner image having been formed thereon by the second image-forming unit, the third developing means also serving as a cleaning means for recovering the toner remaining on the third latent image-holding member after the image transfer to perform cleaning, wherein the third latent image-holding member has a surface having a contact angle for water of not less than 85°.

30. The image-forming apparatus according to claim 29, wherein the first toner, the second toner, and the third toner are respectively any of a magenta toner, a cyan toner and a yellow toner, constituting a combination of the magenta toner, the cyan toner, and the yellow toner, and the combination of three color toners forms a full-color image.

31. The image-forming apparatus according to claim 29, wherein the first toner is a yellow toner, the second toner is a magenta toner, and the third toner is a cyan toner, and a combination of the yellow toner, the magenta toner, and the cyan toner forms a full-color image.

32. The image-forming apparatus according to claim 29, wherein the contact angle for water of the surface of the second latent image-holding member is not less than 90°, and the contact angle for water of the surface of the third latent image-holding member is not less than 90°.

33. The image-forming apparatus according to claim 29, wherein the contact angle for water of the surface of the second latent image-holding member is not less than 100°, and the contact angle for water of the surface of the third latent image-holding member is not less than 100°.

34. The image-forming apparatus according to claim 29, wherein the first toner has shape factors of SF-1 ranging from 100 to 180 and SF-2 ranging from 100 to 140, the second toner has shape factors of SF-1 ranging from 100 to 180 and SF-2 ranging from 100 to 140, and the third toner has shape factors of SF-1 ranging from 100 to 180 and SF-2 ranging from 100 to 140.

35. The image-forming apparatus according to claim 29, wherein the first toner has shape factors of SF-1 ranging from 100 to 130 and SF-2 ranging from 100 to 120, the second toner has shape factors of SF-1 ranging from 100 to 130 and SF-2 ranging from 100 to 120, and the third toner has shape factors of SF-1 ranging from 100 to 130 and SF-2 ranging from 100 to 120.

36. The image-forming apparatus according to claim 29, wherein the first toner is spherical, the second toner is spherical, and the third toner is spherical.

37. The image-forming apparatus according to claim 1, further comprising a third image-forming unit comprising a third latent image-holding member for holding a third electrostatic latent image, a third latent image-forming means for forming the third electrostatic latent image on the third latent image-holding member, a third developing means for developing the third electrostatic latent image on the third latent image-holding member with a third toner to form a third toner image on the third latent image-holding member, and a third image-transfer means for transferring the third toner image from the third latent image-holding member onto the image-receiving member holding the first toner image having been formed thereon by the first image-forming unit and the second toner image having been formed thereon by the second image-forming unit, the third developing means also serving as a cleaning means for recovering the toner remaining on the third latent image-holding member after the image transfer to perform cleaning; and a fourth image-forming unit comprising a fourth latent image-holding member for holding a fourth electrostatic latent image, a fourth latent image-forming means for forming the fourth electrostatic latent image on the fourth latent image-holding member, a fourth developing means for developing the fourth electrostatic latent image on the fourth latent image-holding member with a fourth toner to form a fourth toner image on the fourth latent image-holding member, and a fourth image-transfer means for transferring the fourth toner image from the fourth latent image-holding member onto the image-receiving member holding the first toner image having been formed thereon by the first image-forming unit, the second toner image having been formed thereon by the second image-forming unit, and the third toner image having been formed thereon by the third image-forming unit, the fourth developing means also serving as a cleaning means for recovering the toner remaining on the fourth latent image-holding member after the image transfer to perform cleaning, wherein the third latent image-holding member has a surface having a contact angle for water of not less than 85°, and the fourth latent image-holding member has a surface having a contact angle for water of not less than 85°.

38. The image-forming apparatus according to claim 37, wherein the first toner, the second toner, the third toner, and the fourth toner are respectively any of a magenta toner, a cyan toner, a yellow toner, and a black toner, constituting a combination of the magenta toner, the cyan toner, the yellow toner, and the black toner, and the combination of four color toners forms a full-color image.

39. The image-forming apparatus according to claim 37, wherein the first toner is a yellow toner, the second toner is a magenta toner, the third toner is a cyan toner, and the fourth toner is a black toner, and the combination of the yellow toner, the magenta toner, the cyan toner, and the black toner forms a full-color image.

40. The image-forming apparatus according to claim 37, wherein the contact angle for water of the surface of the second latent image-holding member is not less than 90°, the contact angle for water of the surface of the third latent image-holding member is not less than 90°, and the contact angle for water of the surface of the fourth latent image-holding member is not less than 90°.

41. The image-forming apparatus according to claim 37, wherein the contact angle for water of the surface of the second latent image-holding member is not less than 100°, the contact angle for water of the surface of the third latent image-holding member is not less than 100°, and the contact angle for water of the surface of the fourth latent image-holding member is not less than 100°.

42. The image-forming apparatus according to claim 37, wherein the first toner has shape factors of SF-1 ranging from 100 to 180 and SF-2 ranging from 100 to 140, the second toner has shape factors of SF-1 ranging from 100 to 180 and SF-2 ranging from 100 to 140, the third toner has shape factors of SF-1 ranging from 100 to 180 and SF-2 ranging from 100 to 140, and the fourth toner has shape factors of SF-1 ranging from 100 to 180 and SF-2 ranging from 100 to 140.

43. The image-forming apparatus according to claim 37, wherein the first toner has shape factors of SF-1 ranging from 100 to 130 and SF-2 ranging from 100 to 120, the second toner has shape factors of SF-1 ranging from 100 to 130 and SF-2 ranging from 100 to 120, the third toner has shape factors of SF-1 ranging from 100 to 130 and SF-2 ranging from 100 to 120, and the fourth toner has shape factors of SF-1 ranging from 100 to 130 and SF-2 ranging from 100 to 120.

44. The image-forming apparatus according to claim 37, wherein the first toner is spherical, the second toner is spherical, the third toner is spherical, and the fourth toner is spherical.

45. An image-forming apparatus comprising:

a first image-forming unit comprising a first latent image-holding member for holding a first electrostatic latent image, a first electrifying means for performing primary electrification of the first latent image-holding member, a first latent image-forming means for forming the first electrostatic latent image on the primarily electrified first latent image-holding member, a first developing means for developing the first electrostatic latent image on the first latent image-holding member with a first toner to form a first toner image on the first latent image-holding member, and a first image-transfer means for transferring the first toner image from the first latent image-holding member onto an image-receiving member; and a second image-forming unit comprising a second latent image-holding member for holding a second electrostatic latent image, a second electrifying means for performing primary electrification of the second latent image-holding member, a second latent image-forming means for forming a second electrostatic latent image on the second latent image-holding member, a second developing means for developing the second electrostatic latent image on the second latent image-holding member with a second toner to form a second toner image on the second latent image-holding member, and a second image-transfer means for transferring the second toner image from the second latent image-holding member onto the image-receiving member holding the first toner image having been formed thereon by the first image-forming unit, wherein in reference to the moving direction of the second latent image-holding member, the second developing means is disposed on the downstream side of the second electrifying means, the second image-transfer means is disposed on the downstream side of the second developing means, and the second electrifying means is disposed on the downstream side of the second image-transfer means, wherein no cleaning member is provided between the second image-transfer means and the second electrifying means and between the second electrifying means and the second developing means to recover toner remaining after the image transfer on the second latent image-holding member by bringing the cleaning member into contact with the surface of the second latent image-holding member, wherein the second developing means also serving as a cleaning means for recovering the toner remaining on the second latent image-holding member after the image transfer to perform cleaning, and wherein the second latent image-holding member has a surface having a contact angle for water of not less than 85°.

46. The image-forming apparatus according to claim 45, wherein the contact angle for water of the surface of the second latent image-holding member is not less than 90°.

47. The image-forming apparatus according to claim 45, wherein the contact angle for water of the surface of the second latent image-holding member is not less than 100°.

48. The image-forming apparatus according to claim 45, wherein the second latent image-holding member is formed from a photosensitive member.

49. The image-forming apparatus according to claim 48, wherein the photosensitive member has a surface layer composed of a base resin and a fluoro-resin dispersed in the base resin.

50. The image-forming apparatus according to claim 49, wherein the surface layer contains the fluoro-resin in an amount ranging from 1 to 150 parts by weight for 100 parts by weight of the base resin.

51. The image-forming apparatus according to claim 49, wherein the surface layer contains the fluoro-resin in an amount ranging from 5 to 100 parts by weight for 100 parts by weight of the base resin.

52. The image-forming apparatus according to claim 45, wherein the first toner has shape factors of SF-1 ranging from 100 to 180 and SF-2 ranging from 100 to 140.

53. The image-forming apparatus according to claim 52, wherein the first toner is prepared by polymerizing a monomer composition containing at least a polymerizable monomer and a coloring agent in a dispersion medium.

54. The image-forming apparatus according to claim 52, wherein the first toner is prepared by melting, blending, pulverizing, and classifying a toner material containing at least a binder resin, and a coloring agent, and treating the classified toner for making the toner spherical in particle shape.

55. The image-forming apparatus according to claim 45, wherein the first toner has shape factors of SF-1 ranging from 100 to 130 and SF-2 ranging from 100 to 120.

56. The image-forming apparatus according to claim 45, wherein the first toner is spherical in particle shape.

57. The image-forming apparatus according to claim 45, wherein the second toner has shape factors of SF-1 ranging from 100 to 180 and SF-2 ranging from 100 to 140.

58. The image-forming apparatus according to claim 57, wherein the second toner is prepared by polymerizing a monomer composition containing at least a polymerizable monomer and a coloring agent in a dispersion medium.

59. The image-forming apparatus according to claim 57, wherein the second toner is prepared by melting, blending, pulverizing, and classifying a toner material containing at least a binder resin, and a coloring agent, and treating the classified toner for making the toner spherical in particle shape.

60. The image-forming apparatus according to claim 45, wherein the second toner has shape factors of SF-1 ranging from 100 to 130 and SF-2 ranging from 100 to 120.

61. The image-forming apparatus according to claim 45, wherein the second toner is spherical in particle shape.

62. The image-forming apparatus according to claim 45, wherein the first toner has shape factors of SF-1 ranging from 100 to 180 and SF-2 ranging from 100 to 140, and the second toner has shape factors of SF-1 ranging from 100 to 180 and SF-2 ranging from 100 to 140.

63. The image-forming apparatus according to claim 62, wherein the first toner is prepared by polymerizing a first monomer composition containing at least a first polymerizable monomer and a first coloring agent in a dispersion medium, and the second toner is prepared by polymerizing a second monomer composition containing at least a second polymerizable monomer and a second coloring agent in a dispersion medium.

64. The image-forming apparatus according to claim 62, wherein the first toner is prepared by melting, blending, pulverizing, and classifying a first toner material containing at least a first binder resin, and a first coloring agent, and treating the classified first toner for making the first toner spherical in particle shape; and the second toner is prepared by melting, blending, pulverizing, and classifying a second toner material containing at least a second binder resin, and a second coloring agent, and treating the classified second toner for making the second toner spherical in particle shape.

65. The image-forming apparatus according to claim 62, wherein the first toner is spherical, and the second toner is spherical.

66. The image-forming apparatus according to claim 45, wherein the first toner has shape factors of SF-1 ranging from 100 to 130 and SF-2 ranging from 100 to 120, and the second toner has shape factors of SF-1 ranging from 100 to 130 and SF-2 ranging from 100 to 120.

67. The image-forming apparatus according to claim 45, wherein the first toner is spherical, and the second toner is spherical.

68. The image-forming apparatus according to claim 45, wherein the second toner comprises toner particles and an external additive.

69. The image-forming apparatus according to claim 45, wherein the second developing means has a two-component developer composed of the second toner and a carrier, and the second electrostatic latent image on the second latent image-holding member is developed by the second toner of a magnetic brush formed from the two-component developer, contacting with second latent image-holding member and by the second toner flying from the magnetic brush.

70. The image-forming apparatus according to claim 69, wherein a development bias can be applied to the second developing means.

71. The image-forming apparatus according to claim 45, wherein the image-receiving member is a recording material.

72. The image-forming apparatus according to claim 45, wherein the image-receiving member is constituted of an intermediate image-receiving member, and the image-forming apparatus comprises a secondary transfer means for secondarily transferring the first toner image and the second toner image transferred on the intermediate image-receiving member entirely onto a recording material.

73. The image-forming apparatus according to claim 45, further comprising a third image-forming unit comprising a third latent image-holding member for holding a third electrostatic latent image, a third electrifying means for performing primary electrification of the third latent image-holding member, a third latent image-forming means for forming the third electrostatic latent image on the primarily electrified third latent image-holding member, a third developing means for developing the third electrostatic latent image on the third latent image-holding member with a third toner to form a third toner image on the third latent image-holding member, and a third image-transfer means for transferring the third toner image from the third latent image-holding member onto the image-receiving member holding the first toner image having been formed thereon by the first image-forming unit and the second toner image having been formed thereon by the second image-forming unit, wherein, in reference to the moving direction of the third latent image-holding member, the third developing means is disposed on the downstream side of the third electrifying means, the third image-transfer means is disposed on the downstream side of the third developing means, and the third electrifying means is disposed on the downstream side of the third image-transfer means, wherein no cleaning member is provided between the third image-transfer means and the third electrifying means and between the third electrifying means and the third developing means to recover toner remaining after the image transfer on the third latent image-holding member by bringing the cleaning member into contact with the surface of the third latent image-holding member, wherein the third developing means also serving as a cleaning means for recovering the toner remaining on the third latent image-holding member after the image transfer to perform cleaning, and wherein the third latent image-holding member has a surface having a contact angle for water of not less than 85°.

74. The image-forming apparatus according to claim 73, wherein the first toner, the second toner, and the third toner are respectively any of a magenta toner, a cyan toner and a yellow toner, constituting a combination of the magenta toner, the cyan toner, and the yellow toner, and the combination of three color toners forms a full-color image.

75. The image-forming apparatus according to claim 73, wherein the first toner is a yellow toner, the second toner is a magenta toner, and the third toner is a cyan toner, and a combination of the yellow toner, the magenta toner, and the cyan toner forms a full-color image.

76. The image-forming apparatus according to claim 73, wherein the contact angle for water of the surface of the second latent image-holding member is not less than 90°, and the contact angle for water of the surface of the third latent image-holding member is not less than 90°.

77. The image-forming apparatus according to claim 73, wherein the contact angle for water of the surface of the second latent image-holding member is not less than 100°, and the contact angle for water of the surface of the third latent image-holding member is not less than 100°.

78. The image-forming apparatus according to claim 73, wherein the first toner has shape factors of SF-1 ranging from 100 to 180 and SF-2 ranging from 100 to 140, the second toner has shape factors of SF-1 ranging from 100 to 180 and SF-2 ranging from 100 to 140, and the third toner has shape factors of SF-1 ranging from 100 to 180 and SF-2 ranging from 100 to 140.

79. The image-forming apparatus according to claim 73, wherein the first toner has shape factors of SF-1 ranging from 100 to 130 and SF-2 ranging from 100 to 120, the second toner has shape factors of SF-1 ranging from 100 to 130 and SF-2 ranging from 100 to 120, and the third toner has shape factors of SF-1 ranging from 100 to 130 and SF-2 ranging from 100 to 120.

80. The image-forming apparatus according to claim 73, wherein the first toner is spherical, the second toner is spherical, and the third toner is spherical.

81. The image-forming apparatus according to claim 45, further comprising a third image-forming unit comprising a third latent image-holding member for holding a third electrostatic latent image, a third electrifying means for performing primary electrification of the third latent image-holding member, a third latent image-forming means for forming the third electrostatic latent image on the primarily electrified third latent image-holding member, a third developing means for developing the third electrostatic latent image on the third latent image-holding member with a third toner to form a third toner image on the third latent image-holding member, and a third image-transfer means for transferring the third toner image from the third latent image-holding member onto the image-receiving member holding the first toner image having been formed thereon by the first image-forming unit and the second toner image having been formed thereon by the second image-forming unit, wherein, in reference to the moving direction of the third latent image-holding member, the third developing means is disposed on the downstream side of the third electrifying means, the third image-transfer means is disposed on the downstream side of the third developing means, and the third electrifying means is disposed on the downstream side of the third image-transfer means, wherein no cleaning member is provided between the third image-transfer means and the third electrifying means and between the third electrifying means and the third developing means to recover toner remaining after the image transfer on the third latent image-holding member by bringing the cleaning member into contact with the surface of the third latent image-holding member, wherein the third developing means also serving as a cleaning means for recovering the toner remaining on the third latent image-holding member after the image transfer to perform cleaning, and wherein the third latent image-holding member has a surface having a contact angle for water of not less than 85°; and a fourth image-forming unit comprising a fourth latent image-holding member for holding a fourth electrostatic latent image, a fourth electrifying means for performing primary electrification of the fourth latent image-holding member, a fourth latent image-forming means for forming the fourth electrostatic latent image on the primarily electrified fourth latent image-holding member, a fourth developing means for developing the fourth electrostatic latent image on the fourth latent image-holding member with a fourth toner to form a fourth toner image on the fourth latent image-holding member, and a fourth image-transfer means for transferring the fourth toner image from the fourth latent image-holding member onto the image-receiving member holding the first toner image having been formed thereon by the first image-forming unit, the second toner image having been formed thereon by the second image-forming unit, and the third toner image having been formed thereon by the third image forming unit, wherein, in reference to the moving direction of the fourth latent image-holding member, the fourth developing means is disposed on the downstream side of the fourth electrifying means, the fourth image-transfer means is disposed on the downstream side of the fourth developing means, and the fourth electrifying means is disposed on the downstream side of the fourth image-transfer means, wherein no cleaning member is provided between the fourth image-transfer means and the fourth electrifying means and between the fourth electrifying means and the fourth developing means to recover toner remaining after the image transfer on the fourth latent image-holding member by bringing the cleaning member into contact with the surface of the fourth latent image-holding member, wherein the fourth developing means also serving as a cleaning means for recovering the toner remaining on the fourth latent image-holding member after the image transfer to perform cleaning, and wherein the fourth latent image-holding member has a surface having a contact angle for water of not less than 85°.

82. The image-forming apparatus according to claim 81, wherein the first toner, the second toner, the third toner, and the fourth toner are respectively any of a magenta toner, a cyan toner, a yellow toner, and a black toner, constituting a combination of the magenta toner, the cyan toner, the yellow toner, and the black toner, and the combination of four color toners forms a full-color image.

83. The image-forming apparatus according to claim 81, wherein the first toner is a yellow toner, the second toner is a magenta toner, the third toner is a cyan toner, and the fourth toner is a black toner, and the combination of the yellow toner, the magenta toner, the cyan toner, and the black toner forms a full-color image.

84. The image-forming apparatus according to claim 81, wherein the contact angle for water of the surface of the second latent image-holding member is not less than 90°, the contact angle for water of the surface of the third latent image-holding member is not less than 90°, and the contact angle for water of the surface of the fourth latent image-holding member is not less than 90°.

85. The image-forming apparatus according to claim 81, wherein the contact angle for water of the surface of the second latent image-holding member is not less than 100°, the contact angle for water of the surface of the third latent image-holding member is not less than 100°, and the contact angle for water of the surface of the fourth latent image-holding member is not less than 100°.

86. The image-forming apparatus according to claim 81, wherein the first toner has shape factors of SF-1 ranging from 100 to 180 and SF-2 ranging from 100 to 140, the second toner has shape factors of SF-1 ranging from 100 to 180 and SF-2 ranging from 100 to 140, the third toner has shape factors of SF-1 ranging from 100 to 180 and SF-2 ranging from 100 to 140, and the fourth toner has shape factors of SF-1 ranging from 100 to 180 and SF-2 ranging from 100 to 140.

87. The image-forming apparatus according to claim 81, wherein the first toner has shape factors of SF-1 ranging from 100 to 130 and SF-2 ranging from 100 to 120, the second toner has shape factors of SF-1 ranging from 100 to 130 and SF-2 ranging from 100 to 120, the third toner has shape factors of SF-1 ranging from 100 to 130 and SF-2 ranging from 100 to 120, and the fourth toner has shape factors of SF-1 ranging from 100 to 130 and SF-2 ranging from 100 to 120.

88. The image-forming apparatus according to claim 81, wherein the first toner is spherical, the second toner is spherical, the third toner is spherical, and the fourth toner is spherical.

* * * * *

UNITED STATES PATENT AND TRADEMARK OFFICE

CERTIFICATE OF CORRECTION

PATENT NO. : 5,797,070

DATED : August 18, 1998

INVENTOR(S) : KENICHIRO WAKI, ET AL.

It is certified that error appears in the above-identified patent and that said Letters Patent is hereby corrected as shown below:

On the title page,
Item [75] INVENTORS:

"Tokyo," should read --Musashino,--.

COLUMN 1:

Line 39, "Laid-open" should read --Laid-Open--;
Line 43, "not" should be deleted; and
Line 55, "not" should be deleted.

COLUMN 2:

Line 14, "is" should read --are--; and
Line 41, "is" should read--are--.

COLUMN 5:

Line 24, "monotonously" should read --linearly--.

COLUMN 8:

Line 29, "spherality" should read --sphericity--.

COLUMN 10:

Line 20, "UBk." should read --UBK.--;
Line 26, "UBk." should read --UBK.--; and
Line 40, "UBk" should read --UBK--.

UNITED STATES PATENT AND TRADEMARK OFFICE

CERTIFICATE OF CORRECTION

PATENT NO. : 5,797,070

DATED : August 18, 1998

INVENTOR(S) : KENICHIRO WAKI, ET AL.

It is certified that error appears in the above-identified patent and that said Letters Patent is hereby corrected as shown below:

COLUMN 11:

Line 30, "UBk" should read --UBK--;
Line 41, "UBk." should read --UBK.--; and
Line 61, "much" should read --many--.

COLUMN 15:

Line 32, "developer" should read --developers--.

COLUMN 21:

Line 12, "image forming" should read --image-forming--;
Line 16, "latent" should read --electrostatic latent--;
and
Line 29, "latent" should read --electrostatic latent--.

Signed and Sealed this

Twenty-seventh Day of April, 1999

*Attest:*

Q. TODD DICKINSON

*Attesting Officer*

*Acting Commissioner of Patents and Trademarks*